US009279360B2

(12) United States Patent
Miura et al.

(10) Patent No.: US 9,279,360 B2
(45) Date of Patent: Mar. 8, 2016

(54) COOLING APPARATUS FOR INTERNAL COMBUSTION ENGINE AND MOTORCYCLE INCLUDING THE SAME

(71) Applicant: YAMAHA HATSUDOKI KABUSHIKI KAISHA, Iwata-shi, Shizuoka (JP)

(72) Inventors: Tetsu Miura, Shizuoka (JP); Kazuyuki Maeda, Shizuoka (JP); Makoto Kobayashi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 14/231,984

(22) Filed: Apr. 1, 2014

(65) Prior Publication Data

US 2014/0345548 A1 Nov. 27, 2014

(30) Foreign Application Priority Data

May 23, 2013 (JP) ..... 2013-108639

(51) Int. Cl.
*F01P 7/16* (2006.01)
*F01P 3/12* (2006.01)
*F01P 11/08* (2006.01)

(52) U.S. Cl.
CPC ... *F01P 7/16* (2013.01); *F01P 3/12* (2013.01); *F01P 7/165* (2013.01); *F01P 11/08* (2013.01); *F01P 2050/16* (2013.01); *F01P 2060/04* (2013.01)

(58) Field of Classification Search
CPC ..... F01P 3/02; F01P 2060/04
USPC ..... 123/41.08, 41.01, 41.05, 41.44
See application file for complete search history.

(56) References Cited

U.S. PATENT DOCUMENTS 6,196,168 B1 * 3/2001 Eckerskorn et al. ..... 123/41.33
7,237,513 B2 * 7/2007 Pfeffinger et al. ..... 123/41.29
7,845,316 B2 * 12/2010 Hochmayr et al. ..... 123/41.33
8,291,870 B2 * 10/2012 Moffat et al. ..... 123/41.05

(Continued)

FOREIGN PATENT DOCUMENTS

EP 0 736 703 A1 10/1996
EP 1 892 398 A1 2/2008

(Continued)

OTHER PUBLICATIONS

Official Communication issued in corresponding European Patent Application No. 14160711.9, mailed on Feb. 11, 2015.
Official Communication issued in corresponding European Patent Application No. 14 160 711.9, mailed on Dec. 11, 2015.

*Primary Examiner* — Lindsay Low
*Assistant Examiner* — Long T Tran
(74) *Attorney, Agent, or Firm* — Keating and Bennett, LLP

(57) ABSTRACT

A cooling apparatus includes a cooling passage provided in an internal combustion engine, a water pump, a radiator, a first passage through which the water pump and the cooling passage are connected to each other, a second passage through which the cooling passage and the radiator are connected to each other, a third passage through which the radiator and the water pump are connected to each other, and an oil cooler passage provided with an oil cooler. An in-line type thermostat is provided at any position in a portion of a cooling water circuit which leads from a first end portion to a second end portion via the second passage, the radiator, and the third passage.

22 Claims, 16 Drawing Sheets

(56) References Cited

U.S. PATENT DOCUMENTS

| | | | | |
|---|---|---|---|---|
| 2004/0216701 | A1* | 11/2004 | Hutchins | 123/41.08 |
| 2006/0254539 | A1* | 11/2006 | Emmersberger | 123/41.47 |
| 2007/0221160 | A1* | 9/2007 | Haze et al. | 123/197.1 |
| 2009/0020080 | A1* | 1/2009 | Kowada | 123/41.08 |
| 2009/0255489 | A1 | 10/2009 | Fujiwara et al. | |
| 2011/0107983 | A1* | 5/2011 | Magro | 123/41.1 |
| 2013/0125843 | A1* | 5/2013 | Fukuoka et al. | 123/41.1 |

FOREIGN PATENT DOCUMENTS

| | | | |
|---|---|---|---|
| EP | 2 116 704 | A2 | 11/2009 |
| GB | 2 309 075 | A | 7/1997 |
| JP | 62-67218 | A | 3/1987 |
| JP | 10-231727 | A | 9/1998 |
| JP | 2007-002678 | A | 1/2007 |
| JP | 2007-77908 | A | 3/2007 |

* cited by examiner

COOLING APPARATUS FOR INTERNAL COMBUSTION ENGINE AND MOTORCYCLE INCLUDING THE SAME

BACKGROUND OF THE INVENTION

1. Field of the Invention

The present invention relates to cooling apparatuses for internal combustion engines and motorcycles including the cooling apparatuses.

The present application claims priority to Japanese Patent Application No. 2013-108639 filed in Japan on May 23, 2013, the entire contents of which are hereby incorporated by reference.

2. Description of the Related Art

A water-cooling cooling apparatus is conventionally known as an apparatus for cooling an internal combustion engine of a motorcycle. A cooling apparatus of this type includes a radiator, water piping through which the radiator and an internal combustion engine are connected to each other, a water pump that conveys cooling water, and a thermostat that adjusts a temperature of the cooling water. The cooling water flows through the internal combustion engine and the radiator in sequence. The cooling water increases in temperature by cooling the internal combustion engine, and decreases in temperature by radiating heat through the radiator. The thermostat is operated to reduce a flow rate of the cooling water when the temperature of the cooling water is low, and increase the flow rate of the cooling water when the temperature of the cooling water is high. The flow rate of the cooling water to be supplied to the internal combustion engine is adjusted in this manner, thus keeping the temperature of the cooling water within an appropriate range.

When the internal combustion engine is started up, it is desirable to warm the internal combustion engine promptly from the standpoint of fuel efficiency improvement, for example. In order to warm the internal combustion engine promptly, the flow rate of the cooling water flowing through the radiator is preferably reduced so that the amount of heat radiated from the cooling water is decreased. For example, in a conventionally known cooling apparatus for an internal combustion engine, a flow rate of cooling water flowing through a radiator is reduced during a warming up operation.

FIG. 3-2 of JP 2007-2678 A discloses a cooling apparatus in which a flow rate of cooling water flowing through a radiator is reduced during a warming up operation of a motorcycle. As illustrated in FIG. 16A, a cooling apparatus 300 disclosed in JP 2007-2678 A includes a radiator 301, a water pump 302, a thermostat 303 connected to a suction port of the water pump 302, and an oil cooler 304. The cooling apparatus 300 further includes a main passage made up of a passage 306 through which a discharge port of the water pump 302 and an internal combustion engine 305 are connected to each other, a passage 307 through which the internal combustion engine 305 and the radiator 301 are connected to each other, and a passage 308 through which the radiator 301 and the thermostat 303 are connected to each other. The cooling apparatus 300 further includes an oil cooler passage 309 made up of a passage 309*a* through which the passage 306 and the oil cooler 304 are connected to each other, and a passage 309*b* through which the oil cooler 304 and the radiator 301 are connected to each other. The cooling apparatus 300 further includes a bypass passage 310 through which the passage 307 and the thermostat 303 are connected to each other.

At the time of startup of the internal combustion engine 305, the internal combustion engine 305 has a low temperature, and therefore, the cooling water has a low temperature.

When the temperature of the cooling water is low, the thermostat 303 operates to shut off communication between the passage 308 and the passage 306 so as to block circulation of the cooling water through the main passage. As a result, the cooling water flows as indicated by arrows in FIG. 16A. Specifically, the cooling water discharged from the water pump 302 is distributed so that some of the cooling water passes through the internal combustion engine 305 and the remainder of the cooling water passes through the oil cooler 304. The cooling water that has passed through the internal combustion engine 305 and the cooling water that has passed through the oil cooler 304 then merge with each other, and the merged cooling water flows through the bypass passage 310 and subsequently returns to the water pump 302 via the thermostat 303.

Upon lapse of a certain period of time from the startup, the temperature of the internal combustion engine 305 increases, and therefore, the temperature of the cooling water increases. When the temperature of the cooling water is high, the thermostat 303 operates to shut off communication between the bypass passage 310 and the passage 306 and allow communication between the passage 308 and the passage 306. As a result, the cooling water flows as indicated by arrows in FIG. 16B, and the cooling water circulates through the main passage. Specifically, the cooling water discharged from the water pump 302 is distributed so that some of the cooling water flows through the internal combustion engine 305 and the remainder of the cooling water passes through the oil cooler 304. The cooling water that has passed through the internal combustion engine 305 and the cooling water that has passed through the oil cooler 304 then merge with each other, and the merged cooling water flows through the radiator 301 and subsequently returns to the water pump 302 via the thermostat 303.

However, the cooling apparatus 300 requires the bypass passage 310 through which the cooling water flows only during a warming up operation, in addition to the main passage through which the cooling water is supplied to the radiator 301 and the oil cooler passage 309 through which the cooling water is supplied to the oil cooler 304. Hence, the number of components of the cooling apparatus 300 is increased, which contributes to an increase in cost. For motorcycles, there is a strong demand for weight reduction of vehicle-mounted components. However, the cooling apparatus 300 has difficulty in achieving weight reduction because the bypass passage 310 cannot be removed therefrom. Moreover, motorcycles are subject to considerable constraints in terms of piping layout. The cooling apparatus 300 is likely to complicate piping layout because the bypass passage 310 has to be additionally disposed.

SUMMARY OF THE INVENTION

Accordingly, preferred embodiments of the present invention provide a water-cooling cooling apparatus that cools an internal combustion engine of a motorcycle, wherein the cooling apparatus achieves a smaller number of components, lighter weight, or greater layout flexibility than heretofore possible.

A cooling apparatus for an internal combustion engine according to a preferred embodiment of the present invention is preferably a cooling apparatus for cooling an internal combustion engine of a motorcycle. The cooling apparatus includes a cooling passage that is provided in the internal combustion engine and includes an inlet through which cooling water flows in and an outlet through which the cooling water flows out; a water pump that includes a discharge port through which the cooling water is discharged and a suction port through which the cooling water is drawn in; a radiator that includes an inlet through which the cooling water flows in and an outlet through which the cooling water flows out; a first passage connected to the discharge port of the water pump and the inlet of the cooling passage, a second passage connected to the outlet of the cooling passage and the inlet of the radiator; a third passage connected to the outlet of the radiator and the suction port of the water pump; an oil cooler passage that includes a first end portion connected to the second passage and a second end portion connected to the third passage and that is provided with an oil cooler; and a thermostat provided in a portion of the second passage which is located between the first end portion and the inlet of the radiator, in the radiator, or in a portion of the third passage which is located between the outlet of the radiator and the second end portion, the thermostat being arranged to close when a temperature of the cooling water is lower than a reference temperature and to open when the temperature of the cooling water is equal to or higher than the reference temperature.

In the above-described cooling apparatus, during a warming up operation, the temperature of the cooling water is lower than the reference temperature, and therefore, the thermostat is closed. The cooling water discharged from the discharge port of the water pump passes through the first passage and the cooling passage, and then flows into the second passage. Since the thermostat is closed, the cooling water that has flowed into the second passage then flows into the third passage via the oil cooler passage provided with the oil cooler without passing through the radiator. The cooling water that has flowed into the third passage is then sucked into the suction port of the water pump. Thus, the cooling water does not flow through the radiator, and therefore, the temperature of the cooling water is likely to increase, which prevents cooling the internal combustion engine with the cooling water. As a result, the internal combustion engine is promptly warmed. During the warming up operation, the cooling water flows through the oil cooler passage provided with the oil cooler, thus eliminating the need for a bypass passage used only during the warming up operation. Accordingly, a reduction in the number of components, a reduction in weight, or an increase in layout flexibility can be achieved in the cooling apparatus.

According to a preferred embodiment of the present invention, the thermostat is preferably provided in the portion of the third passage which is located between the outlet of the radiator and the second end portion.

According to the above-described preferred embodiment, the thermostat is preferably provided in the third passage, and therefore, whether or not to supply the cooling water to the radiator is decided on the basis of the temperature of the cooling water prior to being supplied to the internal combustion engine. As a result, prompt warming up of the internal combustion engine is suitably performed.

According another preferred embodiment of the present invention, the thermostat preferably includes a thermostat case provided with a first inlet, a second inlet, and an outlet; and a valve body contained inside the thermostat case to open and close communication between the first inlet and the outlet. The third passage preferably includes an upstream passage connected to the outlet of the radiator and the first inlet of the thermostat case, and a downstream passage connected to the outlet of the thermostat case and the suction port of the water pump. The oil cooler passage preferably includes a downstream passage that includes an end portion connected to the oil cooler, and an end portion connected to the second inlet of the thermostat case and serving as the second end portion. The thermostat is preferably arranged to shut off communication between the first inlet and the outlet by the valve body and allow communication between the second inlet and the outlet when the temperature of the cooling water is lower than the reference temperature, and to allow communication between the first inlet and the outlet and allow communication between the second inlet and the outlet when the temperature of the cooling water is equal to or higher than the reference temperature.

According to the above-described preferred embodiment, an "in-line type" thermostat can be used, and therefore, the cooling apparatus is reduced in size or cost.

According to still another preferred embodiment of the present invention, the thermostat is preferably provided in the portion of the second passage which is located between the first end portion and the inlet of the radiator.

According to the above-described preferred embodiment, the thermostat does not have to be provided in the third passage. In the preferred embodiment where the thermostat is provided in the second passage, a reduction in the number of components, a reduction in weight, or an increase in layout flexibility is achieved in the cooling apparatus.

According to yet another preferred embodiment of the present invention, the thermostat preferably includes a thermostat case provided with an inlet, a first outlet, and a second outlet; and a valve body contained inside the thermostat case to open and close communication between the inlet and the first outlet. The second passage preferably includes an upstream passage connected to the outlet of the cooling passage and the inlet of the thermostat case, and a downstream passage connected to the first outlet of the thermostat case and the inlet of the radiator. The oil cooler passage preferably includes an upstream passage that includes an end portion connected to the second outlet of the thermostat case and serving as the first end portion, and an end portion connected to the oil cooler. The thermostat is preferably arranged to shut off communication between the inlet and the first outlet by the valve body and allow communication between the inlet and the second outlet when the temperature of the cooling water is lower than the reference temperature, and to allow communication between the inlet and the first outlet and allow communication between the inlet and the second outlet when the temperature of the cooling water is equal to or higher than the reference temperature.

According to the above-described preferred embodiment, an "in-line type" thermostat can be used, and therefore, the cooling apparatus is reduced in size or cost.

According to still yet another preferred embodiment of the present invention, the oil cooler passage preferably has a flow passage cross-sectional area smaller than flow passage cross-sectional areas of each of the second passage and the third passage.

In the cooling apparatus, the cooling water flows through both of the oil cooler passage and the radiator during a normal operation. According to the above-described preferred embodiment, the flow passage cross-sectional area of the oil cooler passage is smaller than the flow passage cross-sectional areas of each of the second passage and the third passage, and therefore, a flow rate of the cooling water flowing through the radiator during the normal operation will not be insufficient. As a result, during the normal operation, the cooling water is allowed to sufficiently radiate heat through the radiator.

According to another preferred embodiment of the present invention, the water pump is preferably fixed to the internal combustion engine.

According to the above-described preferred embodiment, a distance between the water pump and the cooling passage of the internal combustion engine is reduced, thus making it possible to shorten the first passage. Hence, a reduction in weight or an improvement in layout flexibility is achieved in the cooling apparatus.

According to still another preferred embodiment of the present invention, the first passage is preferably provided inside the internal combustion engine.

According to the above-described preferred embodiment, water piping defining the first passage is unnecessary. As a result, a further reduction in the number of components, a further reduction in weight, or a further increase in layout flexibility is achieved.

According to yet another preferred embodiment of the present invention, the internal combustion engine preferably includes a cylinder body that includes cylinders provided therein, and a cylinder head that is connected to the cylinder body and includes an intake port through which air is introduced and an exhaust port through which exhaust gas is discharged. The water pump is preferably attached to the cylinder body, and at least a portion of the first passage is preferably provided inside the cylinder body.

According to the above-described preferred embodiment, a suitable cooling apparatus in which water piping defining the first passage is unnecessary is obtained.

A motorcycle according to a preferred embodiment of the present invention includes the above-described cooling apparatus.

Thus, a motorcycle that achieves the above-described effects is obtained.

According to another preferred embodiment of the present invention, the oil cooler passage is preferably disposed forward of the internal combustion engine.

According to the above-described preferred embodiment, the cooling apparatus is suitably disposed for the internal combustion engine.

According still another preferred embodiment of the present invention, the oil cooler is preferably disposed forward of the internal combustion engine.

According to the above-described preferred embodiment, the cooling apparatus is suitably disposed for the internal combustion engine.

According to yet another preferred embodiment of the present invention, the radiator is preferably disposed forward of the internal combustion engine, and the oil cooler is preferably disposed rearward of the radiator.

According to the above-described preferred embodiment, the cooling apparatus is suitably disposed for the internal combustion engine.

According to still yet another preferred embodiment of the present invention, both of the water pump and the thermostat are preferably disposed rightward of a motorcycle center line in a front view of the motorcycle, or disposed leftward of the motorcycle center line in the front view of the motorcycle.

According to the above-described preferred embodiment, a distance between the water pump and the thermostat is reduced, thus making it possible to shorten water piping through which the water pump and the thermostat are connected to each other. As a result, the cooling apparatus is compactly disposed.

According to another preferred embodiment of the present invention, the internal combustion engine preferably includes a plurality of cylinders arranged in a lateral direction of the motorcycle. When one of a region located rightward of the motorcycle center line in the front view of the motorcycle and a region located leftward of the motorcycle center line in the front view of the motorcycle is defined as a first region and the other region is defined as a second region, the water pump, the thermostat, and the outlet of the radiator are preferably disposed in the first region, and the outlet of the cooling passage of the internal combustion engine and the inlet of the radiator are preferably disposed in the second region.

According to the above-described preferred embodiment, relative distances between the water pump, the thermostat, and the outlet of the radiator are reduced, thus making it possible to shorten the water piping through which the thermostat and the water pump are connected to each other and water piping through which the outlet of the radiator and the thermostat are connected to each other. Furthermore, a distance between the outlet of the cooling passage and the inlet of the radiator is reduced, thus making it possible to shorten water piping through which the outlet of the cooling passage and the inlet of the radiator are connected to each other. As a result, the cooling apparatus is compactly disposed.

Various preferred embodiments of the present invention provide a water-cooling cooling apparatus that cools an internal combustion engine of a motorcycle, wherein the cooling apparatus has a smaller number of components, lighter weight, or greater layout flexibility than heretofore possible.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
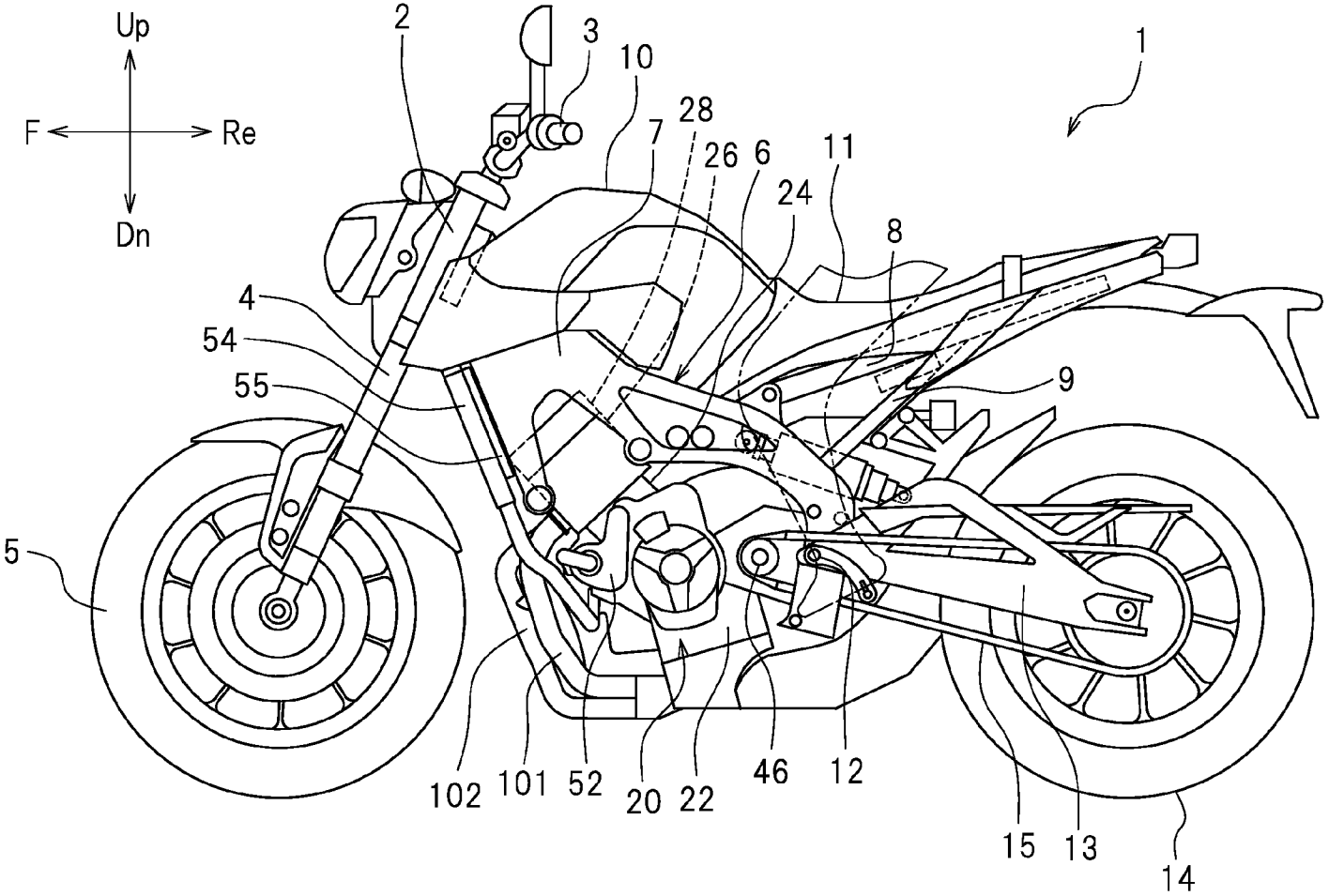
FIG. 1 is a side view of a motorcycle according to a preferred embodiment of the present invention.

FIG. 1 is aside view of a motorcycle (vehicle) 1 according to a preferred embodiment of the present invention. In the following description, unless otherwise specified, "front", "rear", "right", "left", "up" and "down" indicate front, rear, right, left, up and down with respect to a rider (not illustrated) sitting on a seat 11 of the motorcycle 1, respectively. "Up" and "down" correspond to a vertically upward direction and a vertically downward direction when the motorcycle 1 is brought to a stop on a horizontal plane, respectively. Reference signs "F", "Re", "R", "L", "Up" and "Dn" in the drawings represent front, rear, right, left, up and down, respectively. It is to be noted that directions defined as viewed from the front of the vehicle may also be used in the following description. When the directions defined as viewed from the front of the vehicle and the directions defined with respect to the rider sitting on the seat 11 are compared to each other, right and left are reversed. Specifically, left and right defined as viewed from the front of the vehicle correspond to right and left defined with respect to the rider sitting on the seat 11, respectively. Reference signs "R'" and "L'" indicate right and left defined as viewed from the front of the vehicle.

First Preferred Embodiment

As illustrated in FIG. 1, the motorcycle 1 preferably includes a head pipe 2. A handlebar 3 is supported by the head pipe 2 so that the handlebar 3 can be turned to the right and left. The front fork 4 is connected to a lower end portion of the handlebar 3. The front wheel 5 is rotatably supported by a lower end portion of the front fork 4. A body frame 6 is fixed to the head pipe 2. The body frame 6 preferably includes a main frame 7 that extends obliquely downward and rearward from the head pipe 2 in a side view of the vehicle, a seat frame 8 that extends obliquely upward and rearward from the main frame 7 in the side view of the vehicle, and a back stay 9 connected to the main frame 7 and the seat frame 8. A fuel tank 10 is disposed rearward of the head pipe 2, and the seat 11 is disposed rearward of the fuel tank 10. The fuel tank 10 and the seat 11 are supported by the body frame 6. A rear arm 13 is rotatably supported by the main frame 7. The front end portion of the rear arm 13 is connected to the main frame 7 via a pivot shaft 12. A rear wheel 14 is rotatably supported by a rear end portion of the rear arm 13.

An internal combustion engine 20 is supported by the body frame 6. The internal combustion engine 20 preferably includes a crankcase 22, a cylinder body 24 that extends obliquely upward and forward from the crankcase 22, a cylinder head 26 that extends obliquely upward and forward from the cylinder body 24, and a head cover 28 connected to the front end portion of the cylinder head 26. In the present preferred embodiment, the cylinder body 24 is preferably integral with the crankcase 22. Alternatively, the cylinder body 24 and the crankcase 22 may be separate components. The internal combustion engine 20 preferably includes a drive shaft 46 that outputs a driving force. The drive shaft 46 is connected to the rear wheel 14 via a chain 15.

Figure 2:
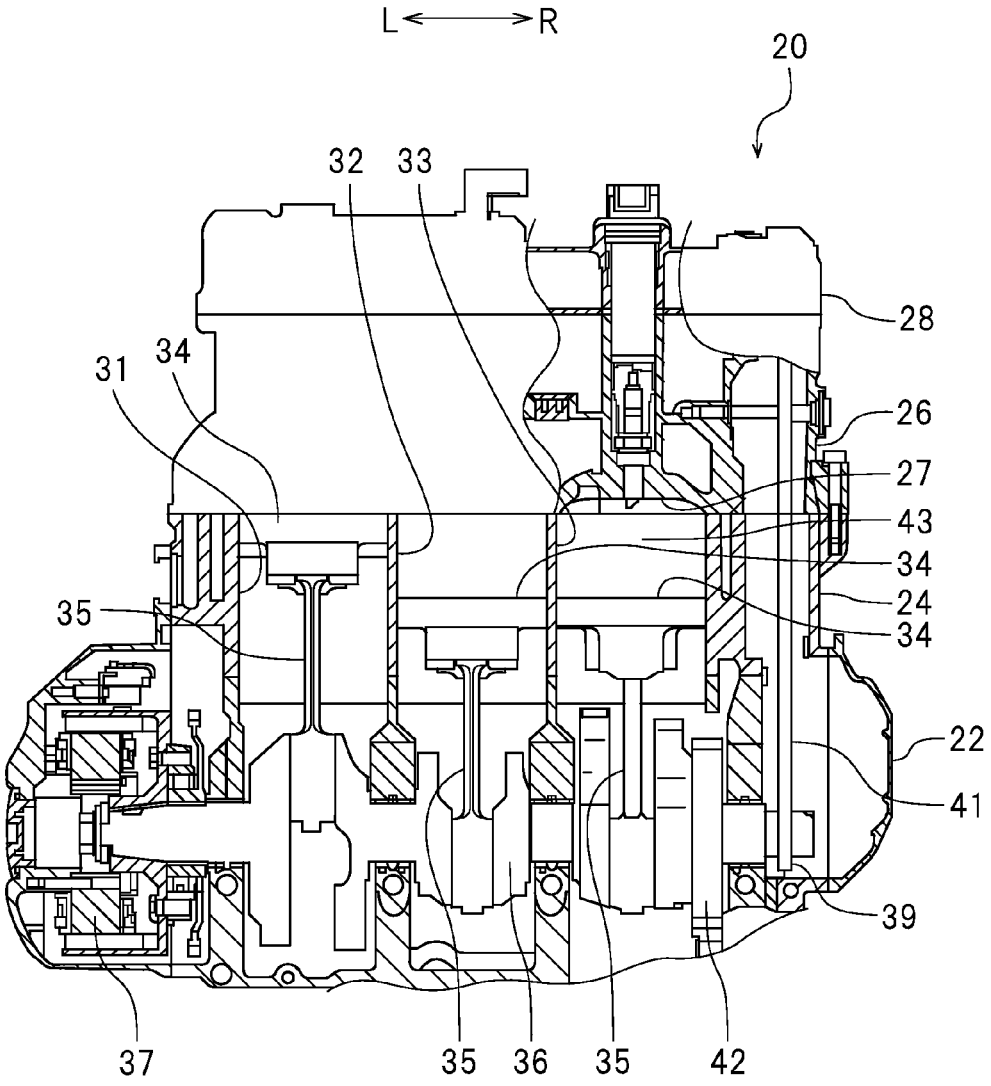
FIG. 2 is a partial cross-sectional view of an internal combustion engine.

As illustrated in FIG. 2, the internal combustion engine 20 is preferably a multi-cylinder internal combustion engine. A first cylinder 31, a second cylinder 32, and a third cylinder 33 are provided inside the cylinder body 24. The first, second, and third cylinders 31, 32, and 33 are disposed in this order from the left to the right. A piston 34 is contained in each of the first, second, and third cylinders 31, 32, and 33. Each piston 34 is connected to a crankshaft 36 via a connecting rod 35. The crankshaft 36 is contained in the crankcase 22.

Concaves 27 are provided in portions of the cylinder head 26 which are located above the first, second, and third cylinders 31, 32, and 33. The cylinders 31 to 33, the pistons 34, and the concaves 27 define combustion chambers 43. The cylinder head 26 is provided with intake ports 95 and exhaust ports 96 (see FIG. 7) which are in communication with the combustion chambers 43. An intake pipe 120 (see FIG. 7) is connected to each intake port 95, and thus air is introduced into the combustion chambers 43 through the intake ports 95. Exhaust pipes 101 to 103 (see FIG. 13), which will be described below, are connected to the exhaust ports 96, and thus exhaust gas is discharged from the combustion chambers 43 through the exhaust ports 96.

A generator 37 is attached to a left end portion of the crankshaft 36. A sprocket 39 is attached to a right end portion of the crankshaft 36. A cam chain 41 is wound around the sprocket 39. A gear 42 is fixed to a portion of the crankshaft 36 which is located leftward of the sprocket 39.

Figure 3:
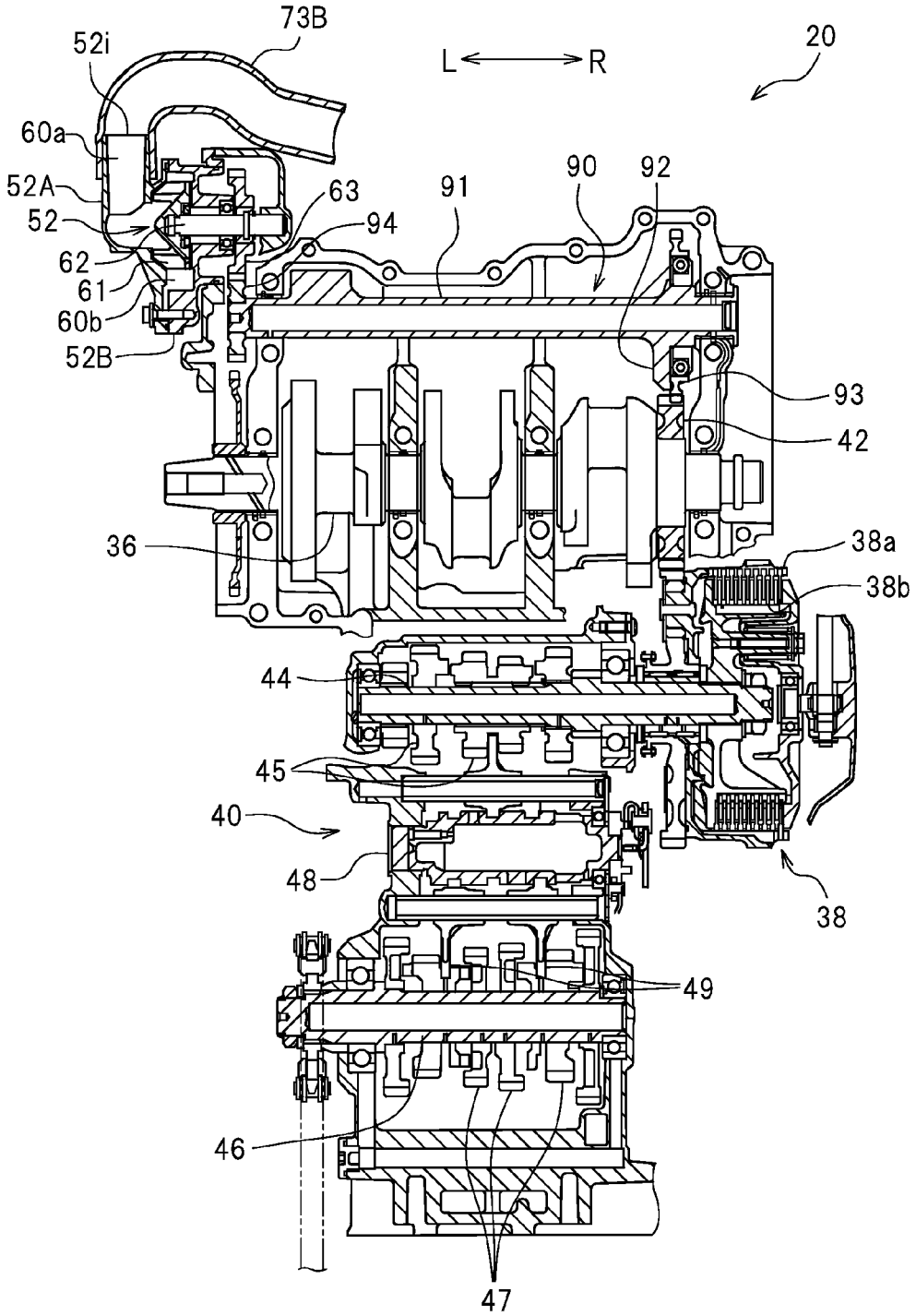
FIG. 3 is another partial cross-sectional view of the internal combustion engine.

As illustrated in FIG. 3, the internal combustion engine 20 preferably includes a clutch 38. The clutch 38 preferably includes a clutch housing 38*a* and a clutch boss 38*b*. The clutch housing 38*a* is connected to the gear 42. A torque of the crankshaft 36 is transmitted to the clutch housing 38*a* via the gear 42. The clutch housing 38*a* rotates together with the crankshaft 36. A main shaft 44 is fixed to the clutch boss 38*b*.

The internal combustion engine 20 preferably includes a transmission 40. The transmission 40 preferably includes a plurality of gears 45 provided at the main shaft 44, a plurality of gears 47 provided at the drive shaft 46, a shift cam 48, and a shift fork 49. Upon rotation of the shift cam 48, the shift fork 49 causes the gears 45 and/or the gears 47 to move axially, thus changing a combination of the gears 45 and 47 which intermesh with each other. As a result, a transmission gear ratio is changed.

The internal combustion engine 20 preferably includes a balancer 90. The balancer 90 preferably includes a balancer shaft 91, and a balancer weight 92 provided at the balancer shaft 91. A gear 93 that intermeshes with the gear 42 is fixed to a right portion of the balancer shaft 91. The balancer shaft 91 is connected to the crankshaft 36 via the gear 42 and the gear 93. The balancer shaft 91 is driven by the crankshaft 36, and is rotated together with the crankshaft 36. A gear 94 is fixed to a left end portion of the balancer shaft 91.

The gear 42 is preferably press-fitted to the crankshaft 36. As mentioned above, the gear 42 intermeshes with both of the clutch housing 38*a* of the clutch 38 and the gear 93 of the balancer 90. The gear 42 is preferably a press-fitted gear, thus making it possible to reduce an outer diameter of the gear 42. A reduction in the outer diameter of the gear 42 reduces a distance between the crankshaft 36 and the main shaft 44 and a distance between the crankshaft 36 and the balancer shaft 91. Note that the crankshaft 36, the main shaft 44, the drive shaft 46, and the balancer shaft 91 extend laterally (i.e., extend in a right-left direction), and are disposed in parallel or substantially in parallel with each other.

The internal combustion engine 20 preferably is a water-cooled internal combustion engine, wherein at least a portion of which is cooled by cooling water, for example. The motorcycle 1 preferably includes a cooling apparatus 50 that cools the internal combustion engine 20. Next, the cooling apparatus 50 will be described.

Figure 4:
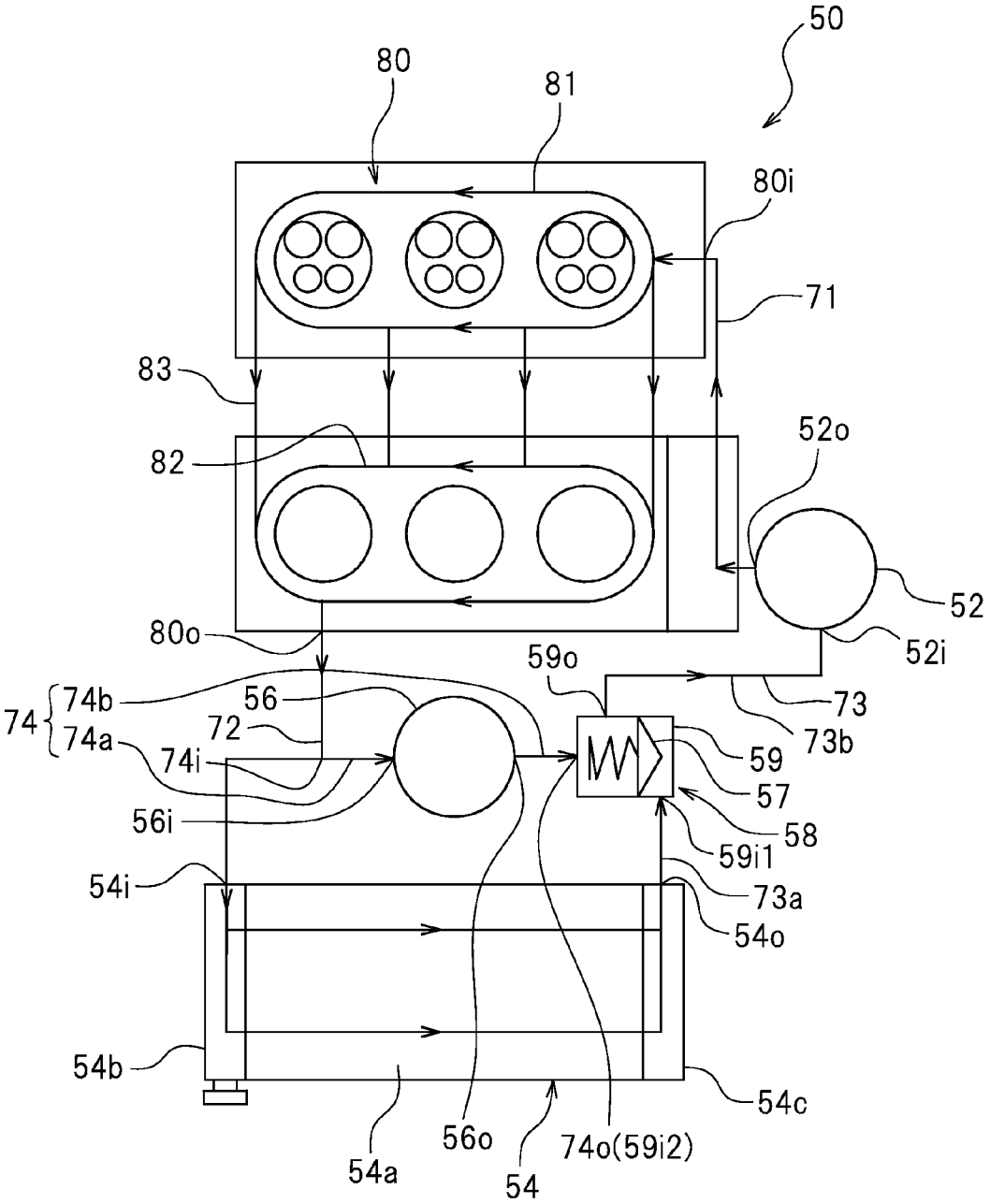
FIG. 4 is a diagram illustrating a cooling water circuit of a cooling apparatus according to a first preferred embodiment of the present invention.

First, a configuration of a cooling water circuit of the cooling apparatus 50 will be described. FIG. 4 is a schematic diagram of the cooling water circuit of the cooling apparatus 50. The cooling apparatus 50 preferably includes a water pump 52, a cooling passage 80 provided inside the internal combustion engine 20, a radiator 54, a thermostat 58, and an oil cooler 56.

The water pump 52 preferably includes a discharge port 52*o* through which cooling water is discharged and a suction port 52*i* through which the cooling water is drawn in. The cooling passage 80 preferably includes an inlet 80*i* through which the cooling water flows in and an outlet 80*o* through which the cooling water flows out. The radiator 54 preferably includes a radiator main body 54*a* through which heat is exchanged between the cooling water and air, an inlet tank 54*b*, and an outlet tank 54*c*. The inlet tank 54*b* is provided with an inlet 54*i* through which the cooling water flows in. The outlet tank 54*c* is provided with an outlet 54*o* through which the cooling water flows out. The oil cooler 56 is provided with an inlet 56*i* through which the cooling water flows in and an outlet 56*o* through which the cooling water flows out.

The cooling apparatus 50 preferably includes a first passage 71 connected to the discharge port 52*o* of the water pump 52 and the inlet 80*i* of the cooling passage 80, a second passage 72 connected to the outlet 80*o* of the cooling passage 80 and the inlet 54*i* of the radiator 54, a third passage 73 connected to the outlet 54*o* of the radiator 54 and the suction port 52*i* of the water pump 52, and an oil cooler passage 74. The oil cooler passage 74 preferably includes a first end portion 74*i* connected to the second passage 72 and a second end portion 74*o* connected to the third passage 73. The oil cooler 56 is provided in the oil cooler passage 74.

The thermostat 58 is provided in a portion of the third passage 73 which is located between the outlet 54*o* of the radiator 54 and the second end portion 74*o*. The thermostat 58 preferably includes a thermostat case 59 provided with a first inlet 59*i*1, a second inlet 59*i*2, and an outlet 59*o*; and a valve body 57 contained inside the thermostat case 59 to open and close communication between the first inlet 59*i*1 and the outlet 59*o*. The third passage 73 preferably includes an upstream passage 73*a* connected to the outlet 54*o* of the radiator 54 and the first inlet 59*i*1 of the thermostat case 59, and a downstream passage 73*b* connected to the outlet 590 of the thermostat case 59 and the suction port 52*i* of the water pump 52. The oil cooler passage 74 preferably includes an upstream passage 74*a* connected to the first end portion 74*i* and the inlet 56*i* of the oil cooler 56, and a downstream passage 74*b* connected to the outlet 56*o* of the oil cooler 56 and the second inlet 59*i*2 of the thermostat case 59. Note that the second inlet 59*i*2 of the thermostat case 59 defines the second end portion 74*o*.

The thermostat 58 is preferably an "in-line type" thermostat, and the second inlet 59*i*2 and the outlet 590 of the thermostat case 59 are always in communication with each other. The thermostat 58 is arranged to shut off communication between the first inlet 59*i*1 and the outlet 590 by the valve body 57 and allow communication between the second inlet 59*i*2 and the outlet 590 when an internal temperature of the thermostat case 59 is lower than a reference temperature. The thermostat 58 is arranged to allow communication between the first inlet 59*i*1 and the outlet 590 and allow communication between the second inlet 59*i*2 and the outlet 590 when the internal temperature of the thermostat case 59 is equal to or higher than the reference temperature. The second inlet 59*i*2 and the outlet 590 are always in communication with each other irrespective of a value of the internal temperature of the thermostat case 59, and thus the cooling water always flows through the oil cooler passage 74. Therefore, the cooling water always flows through the oil cooler 56. Note that the reference temperature is uniquely determined depending on the thermostat 58, but is not limited to any particular temperature. For example, the particular thermostat 58 may be selected from a plurality of the thermostats 58 having different reference temperatures, so that a suitable reference temperature can be set.

In the cooling water circuit, the oil cooler passage 74 is disposed in parallel with the radiator 54, and serves as a bypass passage that allows the cooling water to bypass the radiator 54. As is evident from FIG. 4, no bypass passage other than the oil cooler passage 74 is provided in the cooling apparatus 50. In other words, the cooling apparatus 50 includes the oil cooler passage 74 as the sole bypass passage that allows the cooling water to bypass the radiator 54. The only and sole passage-branching point between the outlet 80*o* of the cooling passage 80 of the internal combustion engine 20 and the inlet 54*i* of the radiator 54 is the first end portion 74*i*. The only and sole passage-branching point between the outlet 54*o* of the radiator 54 and the inlet 80*i* of the cooling passage 80 is the second end portion 74*o*. In the present preferred embodiment, the only and sole passage-branching point between the outlet 54*o* of the radiator 54 and the suction port 52*i* of the water pump 52 is the second end portion 74*o*.

Up to this point, the configuration of the cooling water circuit of the cooling apparatus 50 has been described. Next, structures of main components of the cooling apparatus 50 will be described.

Figure 5:
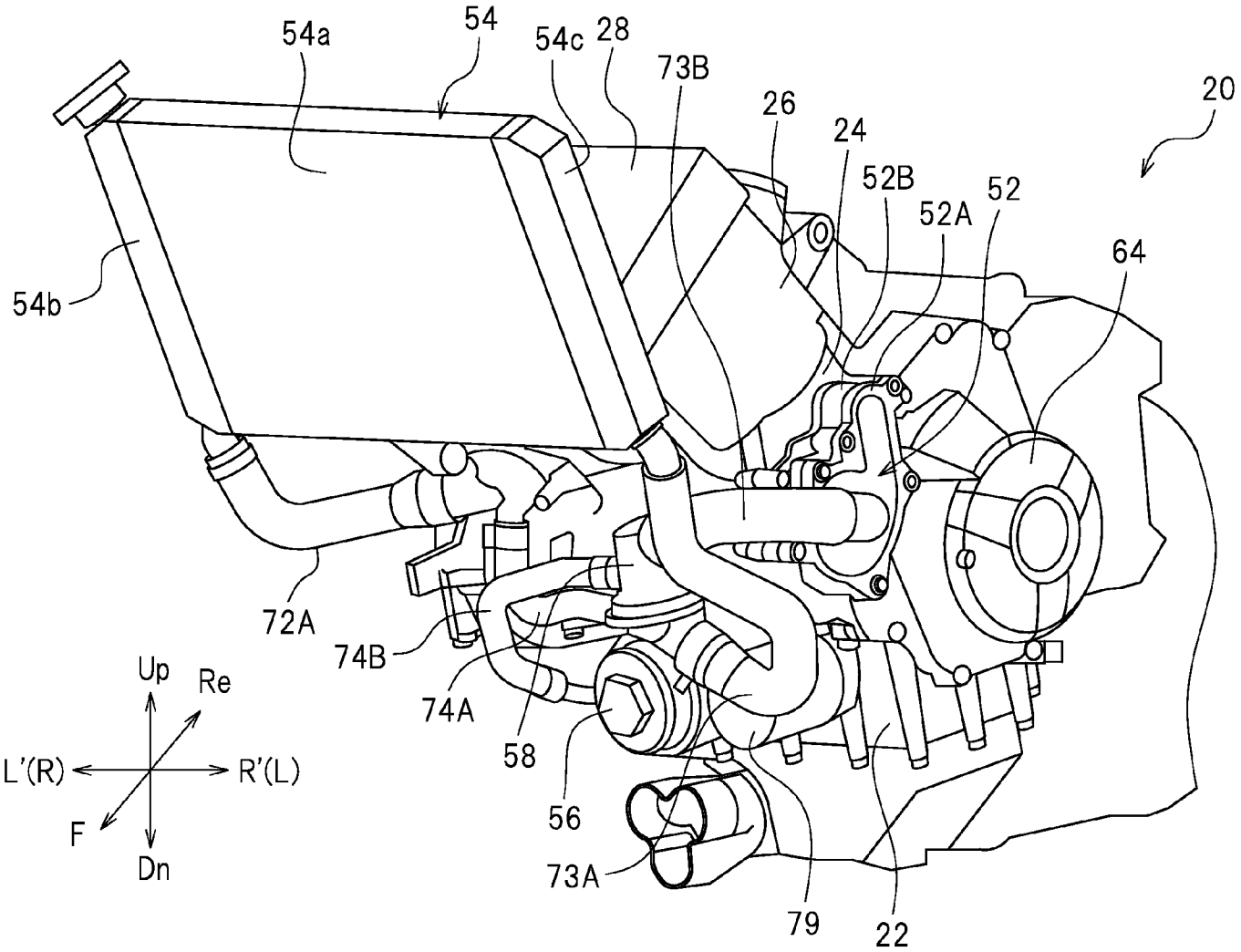
FIG. 5 is a perspective view of the internal combustion engine and the cooling apparatus.
Figure 6:
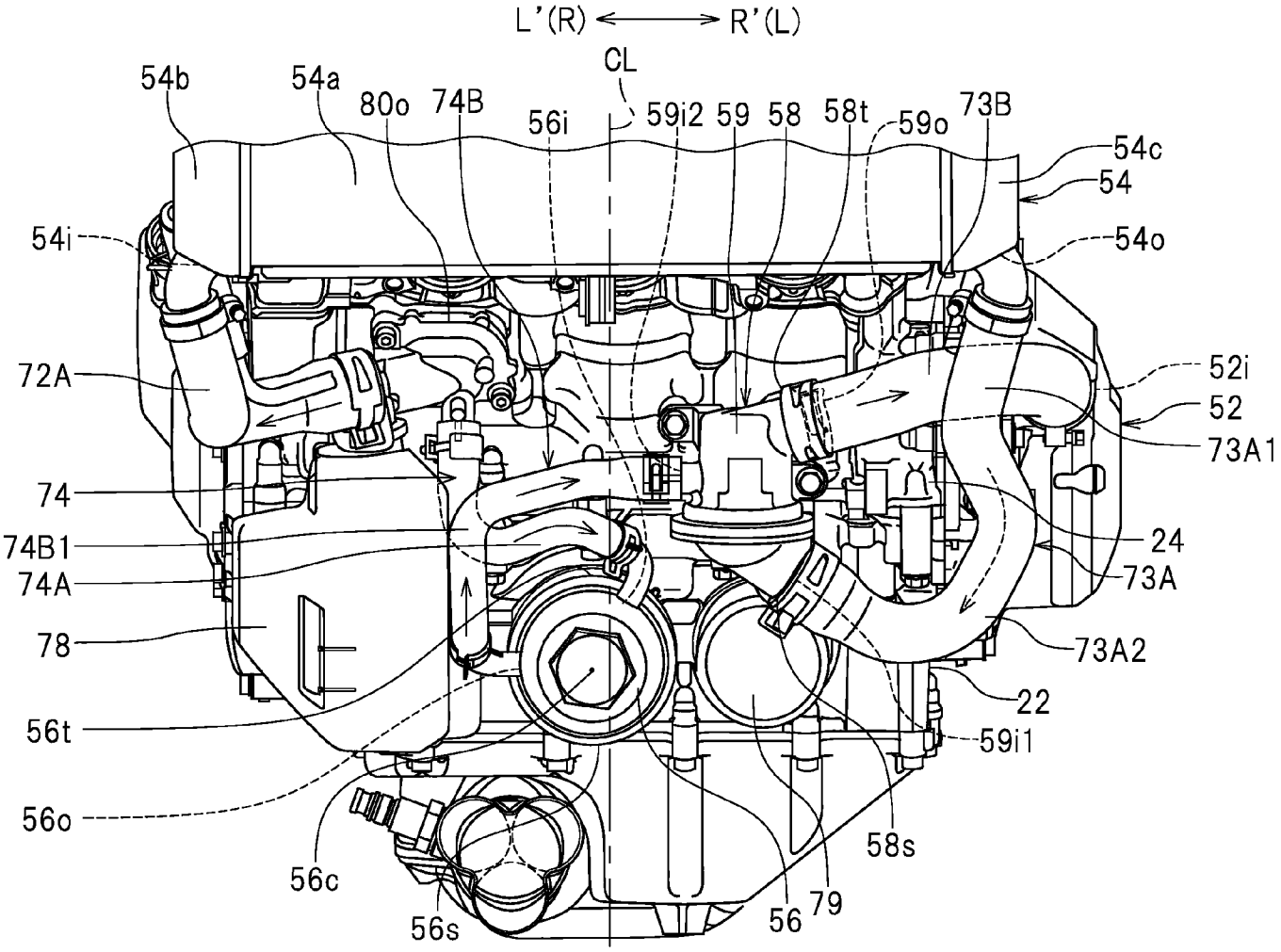
FIG. 6 is a front view of the internal combustion engine and the cooling apparatus.

As illustrated in FIG. 5, the water pump 52 is fixed to the internal combustion engine 20. In this preferred embodiment, the water pump 52 is fixed to the cylinder body 24. Alternatively, the water pump 52 may be fixed to the crankcase 22, for example. The water pump 52 is preferably fixed to a left side wall of the cylinder body 24. As illustrated in FIG. 6, the water pump 52 is disposed rightward of a vehicle center line CL in the front view of the vehicle. Note that the term "vehicle center line CL" refers to a line that passes through a lateral center of the motorcycle 1 and coincides with a center line of the front wheel 5 and a center line of the rear wheel 14.

As illustrated in FIG. 3, the water pump 52 preferably includes a pump housing 52B, a pump cover 52A disposed leftward of the pump housing 52B, an impeller 61 disposed inside the pump housing 52B, and a pump shaft 62 fixed to the impeller 61. The pump cover 52A preferably includes a suction portion 60*a* through which the cooling water is drawn in toward the impeller 61. The pump housing 52B preferably includes a discharge portion 60*b* through which the cooling water ejected from the impeller 61 is discharge, and a passage portion 60*c* (see FIG. 7) through which the cooling water is guided from the discharge portion 60*b* toward the internal combustion engine 20.

A gear 63 is fixed to the pump shaft 62. The gear 63 intermeshes with the gear 94 fixed to the balancer shaft 91. The gear 94 is preferably press-fitted to the balancer shaft 91. The pump shaft 62 is connected to the balancer shaft 91 via the gear 63 and the gear 94. The water pump 52 is driven by the balancer shaft 91. Upon rotation of the balancer shaft 91, the impeller 61 rotates. As already mentioned above, the balancer shaft 91 is driven by the crankshaft 36. Hence, the water pump 52 is driven by the balancer shaft 91 directly, and is driven by the crankshaft 36 indirectly.

Figure 7:
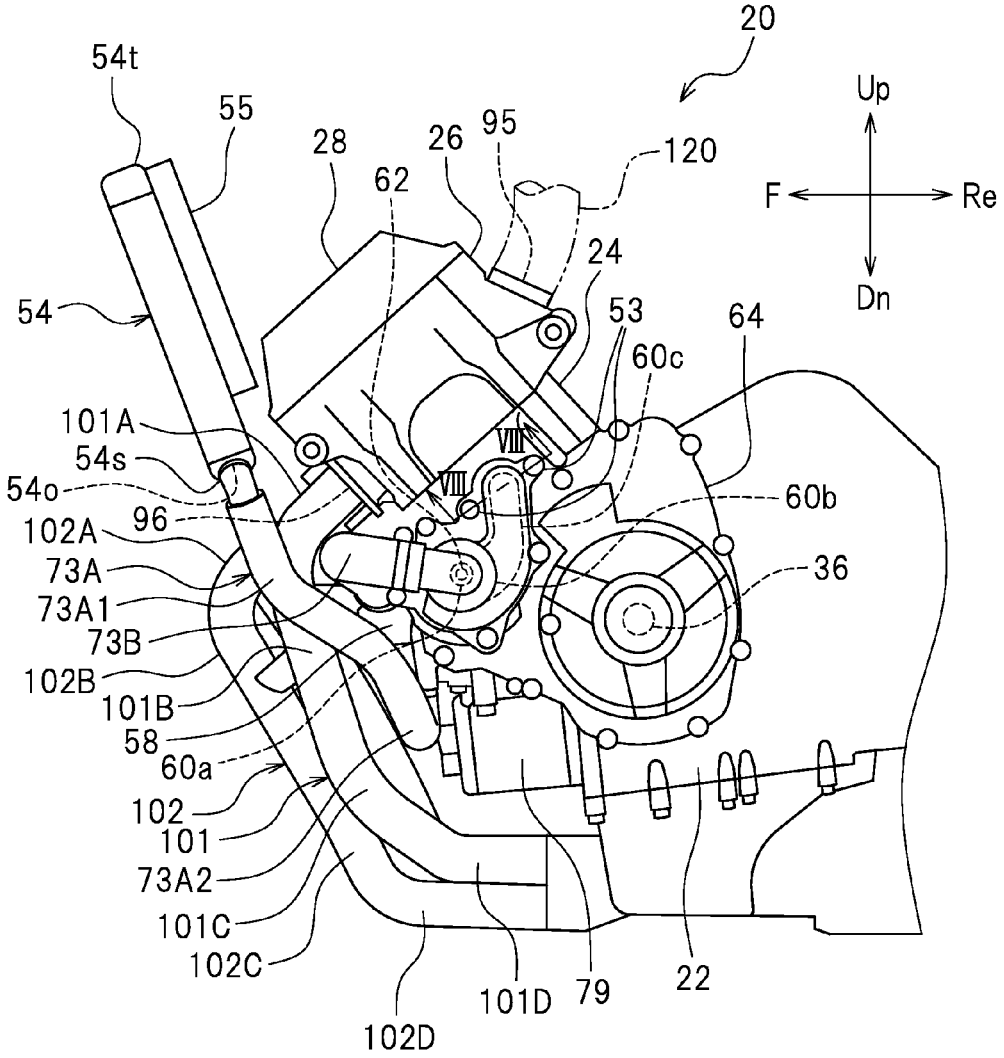
FIG. 7 is a left side view of the internal combustion engine and the cooling apparatus.

As illustrated in FIG. 7, a shaft center of the pump shaft 62 is located above a shaft center of the crankshaft 36 in the side view of the vehicle. The shaft center of the pump shaft 62 is located forward of the shaft center of the crankshaft 36 in the side view of the vehicle.

Figure 8:
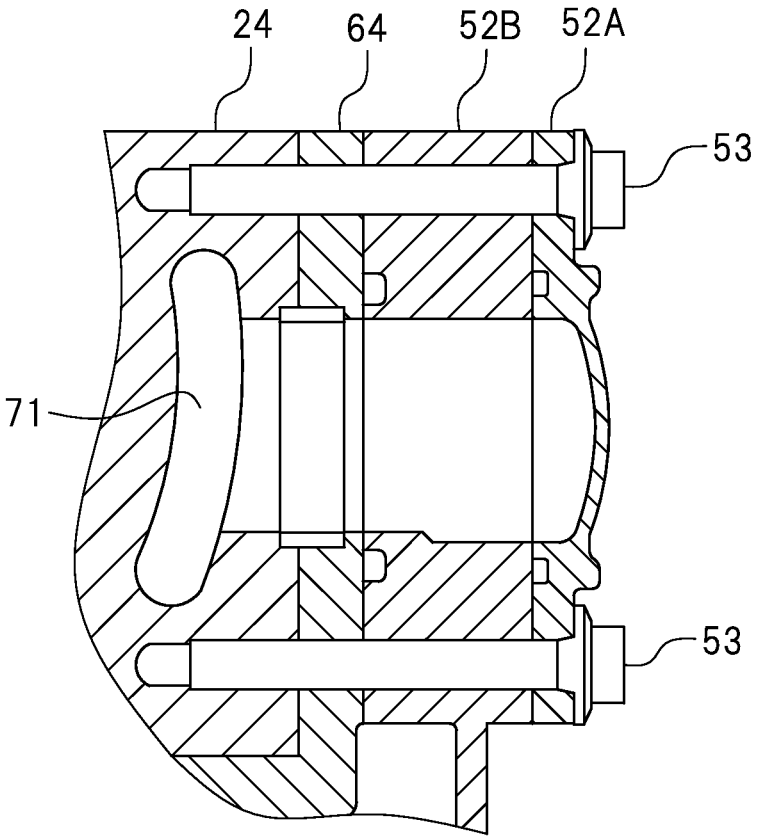
FIG. 8 is a cross-sectional view taken along the line VIII-VIII of FIG. 7.

The water pump 52 is attached to the internal combustion engine 20 together with an ACM cover 64 that covers the generator 37 (see FIG. 2). FIG. 8 is a cross-sectional view taken along the line VIII-VIII of FIG. 7. As illustrated in FIG. 8, a portion of the water pump 52 is attached via bolts 53, for example, to the cylinder body 24 together with the ACM cover 64. A portion of the pump cover 52A, a portion of the pump housing 52B, and a portion of the ACM cover 64 are preferably fixed to the cylinder body 24 via the same bolts 53, for example.

Next, water passages provided inside the internal combustion engine 20 will be described. As already mentioned above with reference to FIG. 4, the cooling apparatus 50 preferably includes the first passage 71 and the cooling passage 80 provided inside the internal combustion engine 20. In the present preferred embodiment, the first passage 71 is provided inside the internal combustion engine 20. The first passage 71 defines an introduction passage through which the cooling water is introduced from the water pump 52 to the cooling passage 80. Hereinafter, the first passage 71 may also be referred to as the "introduction passage 71".

Figure 9:
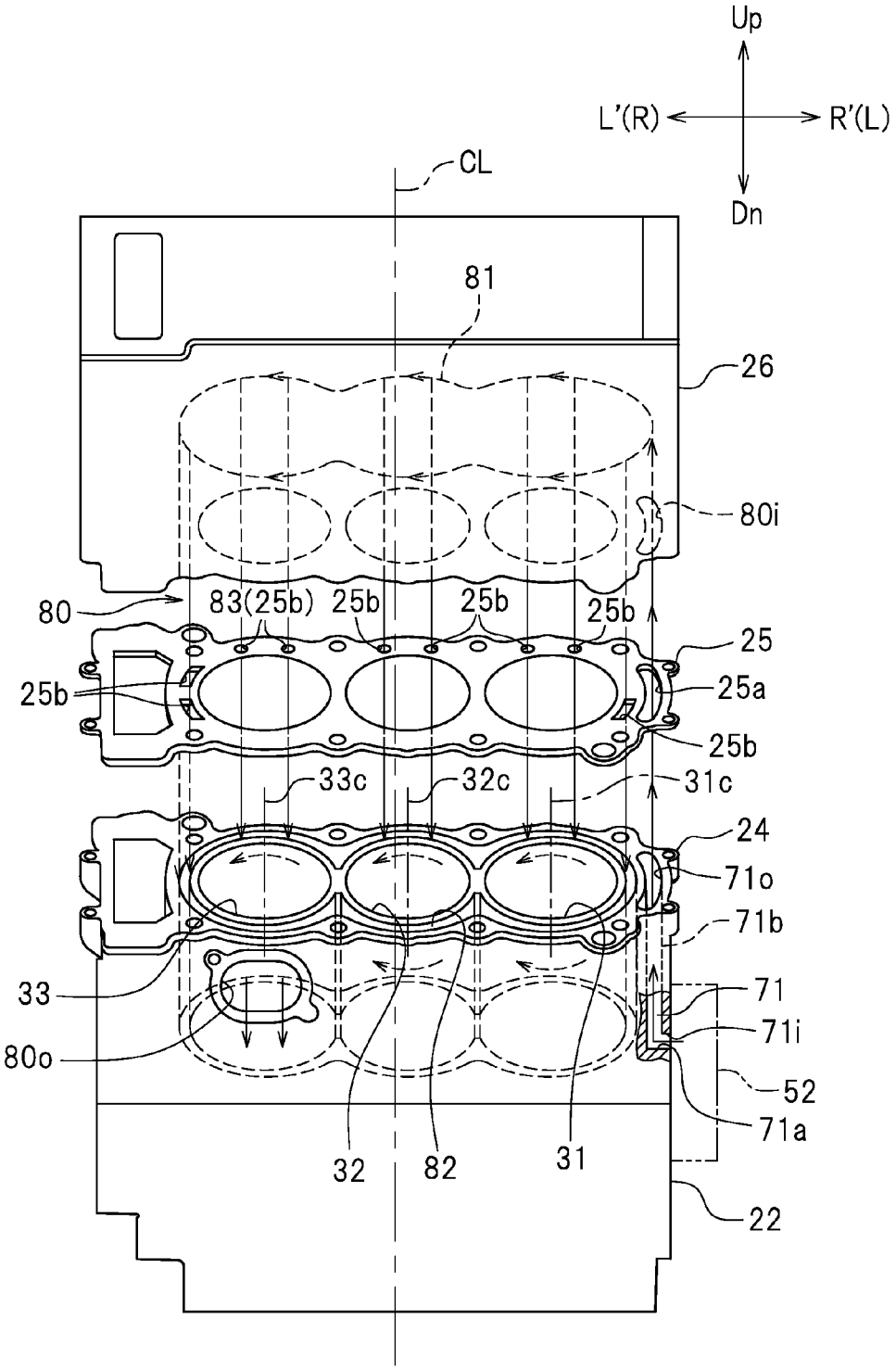
FIG. 9 is a diagram illustrating how water passages of the internal combustion engine are arranged.

As illustrated in FIG. 9, the cooling passage 80 preferably includes a cylinder head cooling passage 81 provided in the cylinder head 26, a cylinder body cooling passage 82 provided in the cylinder body 24, and a connection passage 83 through which the cylinder head cooling passage 81 and the cylinder body cooling passage 82 are connected to each other.

The cylinder head cooling passage 81 is provided around the concave portions 27 (see FIG. 2) of the combustion chambers 43 of the first, second, and third cylinders 31, 32, and 33. The cylinder head cooling passage 81 is provided so that the cooling water flows from the right to the left in the front view of the vehicle.

The cylinder body cooling passage 82 includes a water jacket provided around the first, second, and third cylinders 31, 32, and 33. The cylinder body cooling passage 82 is provided so that the cooling water flows from the right to the left in the front view of the vehicle.

A gasket 25 is sandwiched between the cylinder head 26 and the cylinder body 24. The gasket 25 is provided with a plurality of holes 25*b* located above the cylinder body cooling passage 82 and below the cylinder head cooling passage 81. The holes 25*b* define the connection passage 83. The locations and number of the holes 25*b* defining the connection passage 83 are not limited to any particular locations and number. For example, in this preferred embodiment, the gasket 25 is provided with the two holes 25*b* located leftward of the third cylinder 33, the two holes 25*b* located rearward of the third cylinder 33, the two holes 25*b* located rearward of the second cylinder 32, the two holes 25*b* located rearward of the first cylinder 31, and the single hole 25*b* located rightward of the first cylinder 31.

As illustrated in FIG. 9, the first passage 71 is provided in the cylinder body 24. The first passage 71 is disposed rightward of the rightmost first cylinder 31 in the front view of the vehicle. In the front view of the vehicle, the first passage 71 preferably includes an inlet 71*i* opened rightward, an outlet 710 opened at an upper surface of the cylinder body 24, a lateral portion 71*a* extending leftward from the inlet 71*i*, and a longitudinal portion 71*b* extending parallel or substantially parallel to cylinder axes from the lateral portion 71*a* toward the outlet 71*o*. Similarly to the outlet 71*o*, the longitudinal portion 71*b* has a lateral cross section in the shape of a segment of a circle, for example, the center of which is an axial center (cylinder axis) 31*c* of the first cylinder 31. Note that reference signs "32*c*" and "33*c*" denote axes of the second cylinder 32 and the third cylinder 33, respectively.

The first passage 71 and the cooling passage 80 are both provided inside the internal combustion engine 20, and serve as water passages through which the cooling water flows. Although the cooling passage 80 is provided to allow the cooling water to flow therethrough in order to cool the internal combustion engine 20, the first passage 71 is provided in order to guide the cooling water to the cylinder head cooling passage 81 but not to cool the internal combustion engine 20. The first passage 71 and the cylinder body cooling passage 82 are both provided in the cylinder body 24, but the first passage 71 and the cylinder body cooling passage 82 define different spaces. Inside the cylinder body 24, the first passage 71 and the cylinder body cooling passage 82 are not connected to each other.

Figure 10:
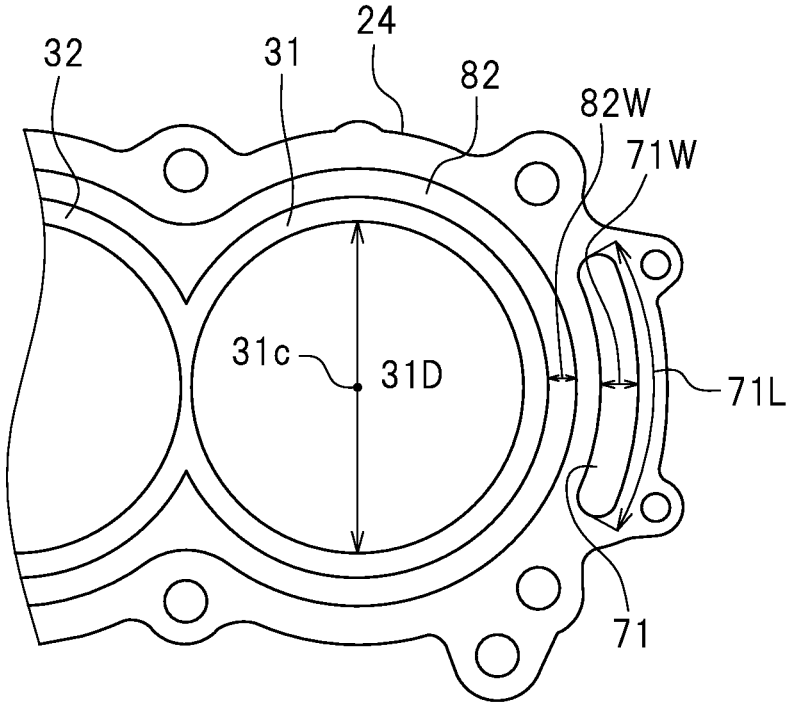
FIG. 10 is a partial plan view of a cylinder body.

The first passage 71 is provided at a position located farther away from the cylinders 31 to 33 than the cylinder body cooling passage 82. A portion of the cylinder body cooling passage 82 is provided between the cylinders 31 to 33 and the first passage 71. As illustrated in FIG. 10, the first passage 71 has a lateral width 71W greater than a lateral width 82W of the cylinder body cooling passage 82, but has a longitudinal width 71L smaller than a length of an entire circumference of the cylinder body cooling passage 82. The first passage 71 has a flow passage cross-sectional area smaller than a flow passage cross-sectional area of the cylinder body cooling passage 82. The first passage 71 is provided in the shape of a segment of a circle, for example, the center of which is the cylinder axis 31*c*, and therefore, the longitudinal width 71L corresponds to a maximum length of the first passage 71 in a cross section orthogonal to the cylinder axis 31*c*. The longitudinal width 71L of the first passage 71 is smaller than an inner diameter 31D of the first cylinder 31 in the cross section orthogonal to the cylinder axis 31*c*. Note that the first to third cylinders 31 to 33 have the same inner diameter. The first passage 71 has a passage length shorter than a passage length of the cylinder body cooling passage 82. The first passage 71 has a surface area smaller than a surface area of the cylinder body cooling passage 82.

As illustrated in FIG. 9, a hole 25*a* is provided in a portion of the gasket 25 which is located above the first passage 71 and below the cylinder head cooling passage 81. The first passage 71 and the cylinder head cooling passage 81 are in communication with each other through the hole 25*a*. The hole 25*a* defines a connection passage through which the first passage 71 and the cylinder head cooling passage 81 are connected to each other. The inlet 80*i* of the cooling passage 80 is provided in a portion of the cylinder head 26 which is located above the hole 25*a*.

The cylinder body 24 is provided with the outlet 80*o* of the cooling passage 80. The outlet 80*o* is connected to the cylinder body cooling passage 82. The outlet 80*o* is disposed leftward of the vehicle center line CL in the front view of the vehicle. The outlet 80*o* is disposed forward of the third cylinder 33. The outlet 80*o* opens obliquely downward and forward. Up to this point, how the water passages of the internal combustion engine 20 are arranged has been described.

As illustrated in FIG. 7, the radiator 54 is disposed forward of the internal combustion engine 20. The radiator 54 is disposed forward of the cylinder body 24, the cylinder head 26, and the head cover 28. The radiator 54 is inclined forward. An upper end portion 54*t* of the radiator 54 is located forward of a lower end portion 54*s* of the radiator 54. A fan 55 is disposed rearward of the radiator 54. As illustrated in FIG. 6, in the front view of the vehicle, the inlet tank 54*b* is disposed leftward of the radiator main body 54*a*, and the outlet tank 54*c* is disposed rightward of the radiator main body 54*a*. In the front view of the vehicle, the inlet tank 54*b* is disposed leftward of the vehicle center line CL, and the outlet tank 54*c* is disposed rightward of the vehicle center line CL. The inlet 54*i* of the radiator 54 is provided at a lower end portion of the inlet tank 54*b*. The outlet 54*o* of the radiator 54 is provided at a lower end portion of the outlet tank 54*c*.

The thermostat 58 is disposed rightward of the vehicle center line CL in the front view of the vehicle. The thermostat 58 is disposed forward of the internal combustion engine 20. The thermostat 58 is disposed forward of the crankcase 22 and the cylinder body 24. The thermostat 58 is disposed below the radiator 54 in the front view of the vehicle. The thermostat case 59 of the thermostat 58 preferably has a vertically elongated and substantially cylindrical shape, for example. In the front view of the vehicle, the first inlet 59*i*1 and the outlet 590 are provided at a right portion of the thermostat case 59, and the second inlet 59*i*2 is provided at a left portion of the thermostat case 59. The first inlet 59*i*1 is provided below the second inlet 59*i*2, and the outlet 590 is provided above the second inlet 59*i*2.

Figure 11:
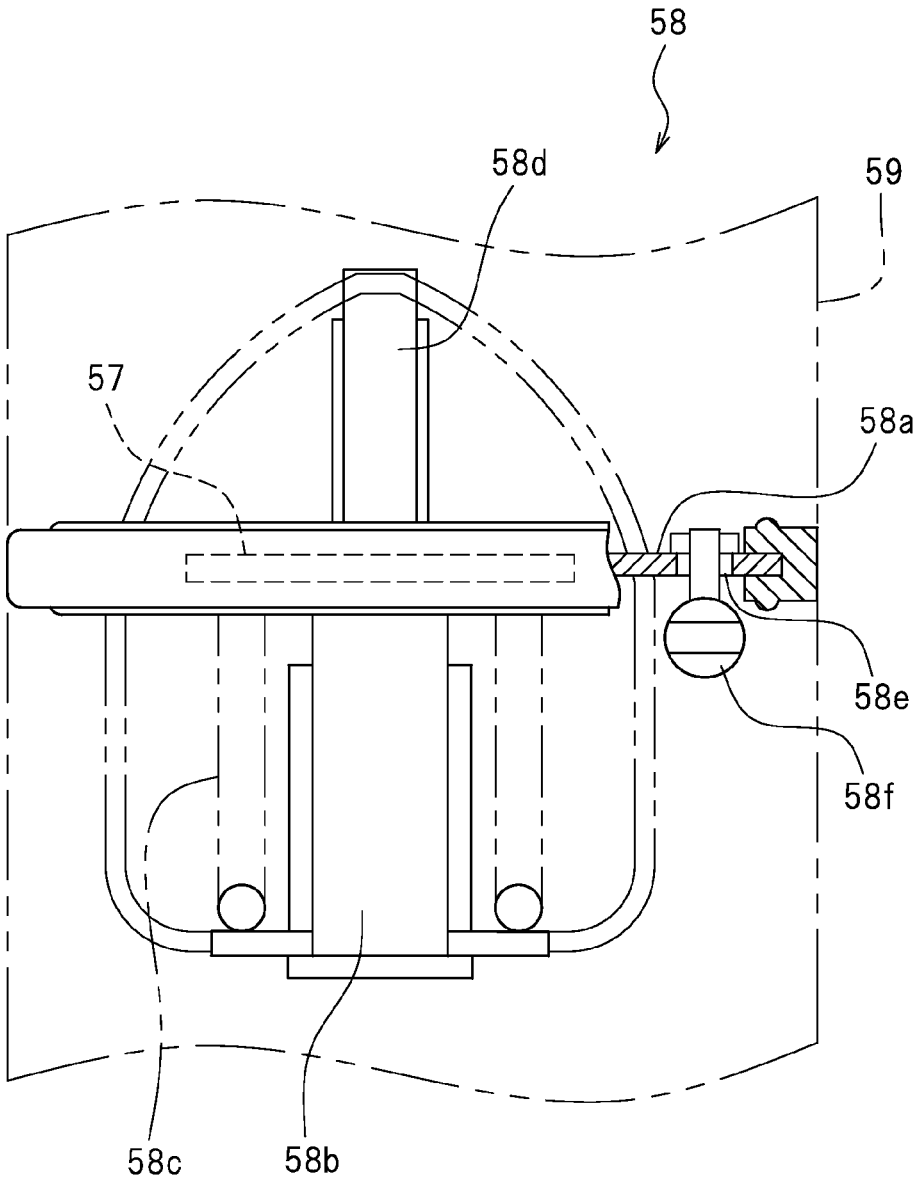
FIG. 11 is a diagram illustrating how main elements inside of a thermostat are arranged.

FIG. 11 is a diagram illustrating how main elements inside of the thermostat 58 are arranged. A thermostat main body 58*a*, a temperature detector 58*b*, a spring 58*c*, and a rod 58*d* are disposed inside the thermostat case 59. The cooling water flows from the bottom to the top in FIG. 11. The temperature detector 58*b* causes the rod 58*d* to move in accordance with a detected temperature, thus opening and closing the valve body 57. The thermostat main body 58*a* is provided with a small hole 58*e*, and a jiggle valve 58*f* is mounted into the small hole 58*e*. The jiggle valve 58*f* is arranged so as to be movable between an upper position at which the small hole 58*e* is closed, and a lower position at which the small hole 58*e* is opened. At the time of injecting the cooling water, the jiggle valve 58*f* is located at the lower position, and thus the small hole 58*e* is opened. Air below the thermostat main body 58*a* is discharged upward through the small hole 58*e*. During operation of the internal combustion engine 20, the jiggle valve 58*f* is moved upward due to a flow of the cooling water, and is positioned at the upper position. As a result, the small hole 58*e* is closed, thus halting a flow of the cooling water through the small hole 58*e*.

The oil cooler 56 cools oil inside the crankcase 22 with the cooling water. The oil cooler 56 is arranged so that heat is exchanged between the cooling water and oil. The oil cooler 56 is attached to the crankcase 22, for example. As illustrated in FIG. 6, the oil cooler 56 is disposed forward of the crankcase 22. The oil cooler 56 preferably has a tubular or substantially tubular shape that extends forward. The oil cooler 56 is disposed on the vehicle center line CL in the front view of the vehicle. A center 56*c* of the oil cooler 56 is located below the thermostat 58. An upper end 56*t* of the oil cooler 56 is located below an upper end 58*t* of the thermostat 58, and a lower end 56*s* of the oil cooler 56 is located below a lower end 58*s* of the thermostat 58. The inlet 56*i* of the oil cooler 56 is provided rightward of the outlet 56*o* and above the outlet 56*o* in the front view of the vehicle.

The outlet 80*o* of the cooling passage 80 of the internal combustion engine 20 and the inlet 54*i* of the radiator 54 are connected to each other through water piping 72A. As used herein, the term "water piping" includes, for example, a pipe, a hose, a tube, a joint, and a combination thereof. The water piping 72A is disposed leftward of the vehicle center line CL in the front view of the vehicle.

The outlet 54*o* of the radiator 54 and the first inlet 59*i*1 of the thermostat 58 are connected to each other through water piping 73A. The outlet 590 of the thermostat 58 and the suction port 52*i* of the water pump 52 are connected to each other through water piping 73B. The water piping 73A and the water piping 73B are disposed rightward of the vehicle center line CL in the front view of the vehicle. A portion 73A1 of the water piping 73A overlaps with the water piping 73B in the front view of the vehicle. As illustrated in FIG. 7, the portion 73A1 of the water piping 73A is disposed forward of the water piping 73B. Another portion 73A2 of the water piping 73A is disposed below the water piping 73B. Although not illustrated, the portion 73A2 of the water piping 73A overlaps with the water piping 73B in a plan view of the vehicle.

Figure 12:
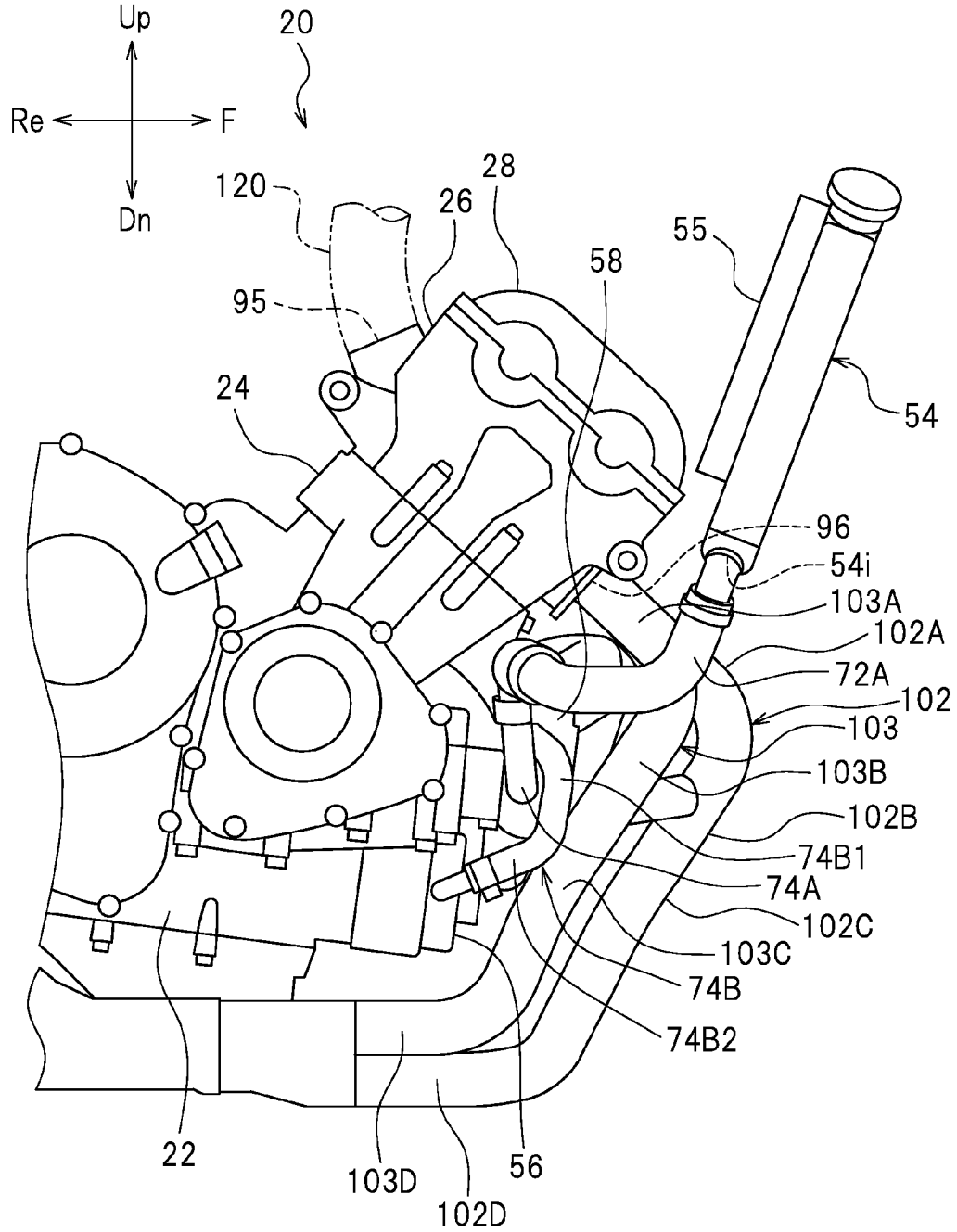
FIG. 12 is a right side view of the internal combustion engine and the cooling apparatus.

As illustrated in FIG. 6, the outlet 80*o* of the cooling passage 80 of the internal combustion engine 20 and the inlet 56*i* of the oil cooler 56 are connected to each other through water piping 74A. The outlet 56*o* of the oil cooler 56 and the second inlet 59*i*2 of the thermostat 58 are connected to each other through water piping 74B. In the front view of the vehicle, the water piping 74A is first extended downward from the outlet 80*o*, and then the water piping 74A is bent rightward and subsequently bent downward so as to be connected to the inlet 56*i*. In the front view of the vehicle, the water piping 74B is first extended leftward from the outlet 56*o*, and then the water piping 74B is bent upward, extended upward and subsequently bent rightward so as to be connected to the second inlet 59*i*2. A portion 74B1 of the water piping 74B overlaps with the water piping 74A in the front view of the vehicle. As illustrated in FIG. 12, the portion 74B1 of the water piping 74B is disposed forward of the water piping 74A. Another portion 74B2 of the water piping 74B is disposed below the water piping 74A. Although not illustrated, the portion 74B2 of the water piping 74B overlaps with the water piping 74A in the plan view of the vehicle.

The above-mentioned second passage 72 (see FIG. 4) preferably includes the water piping 72A. The upstream passage 73*a* and the downstream passage 73*b* of the third passage 73 preferably include the water piping 73A and the water piping 73B, respectively. The upstream passage 74*a* and the downstream passage 74*b* of the oil cooler passage 74 preferably include the water piping 74A and the water piping 74B, respectively. In the structure described in this preferred embodiment, one end of the water piping 74A is connected to the outlet 80*o*, which means that the upstream passage 74*a* of the oil cooler passage 74 is connected to an upstream end of the second passage 72. Alternatively, one end of the water piping 74A may be connected to the water piping 72A instead of being connected to the outlet 80*o*.

As illustrated in FIG. 6, the water piping 74A and the water piping 74B are thinner than the water piping 72A, the water piping 73A, and the water piping 73B. Thus, the oil cooler passage 74 has a flow passage cross-sectional area smaller than flow passage cross-sectional areas of each of the second passage 72 and the third passage 73.

Note that reference signs "78" and "79" denote a recovery tank and an oil filter, respectively. The recovery tank 78 and the oil filter 79 are disposed forward of the internal combustion engine 20 similarly to the thermostat 58 and the oil cooler 56. The oil cooler 56 is disposed rightward of the recovery tank 78 and leftward of the oil filter 79 in the front view of the vehicle. The oil cooler 56 is disposed between the recovery tank 78 and the oil filter 79 in the front view of the vehicle.

Figure 13:
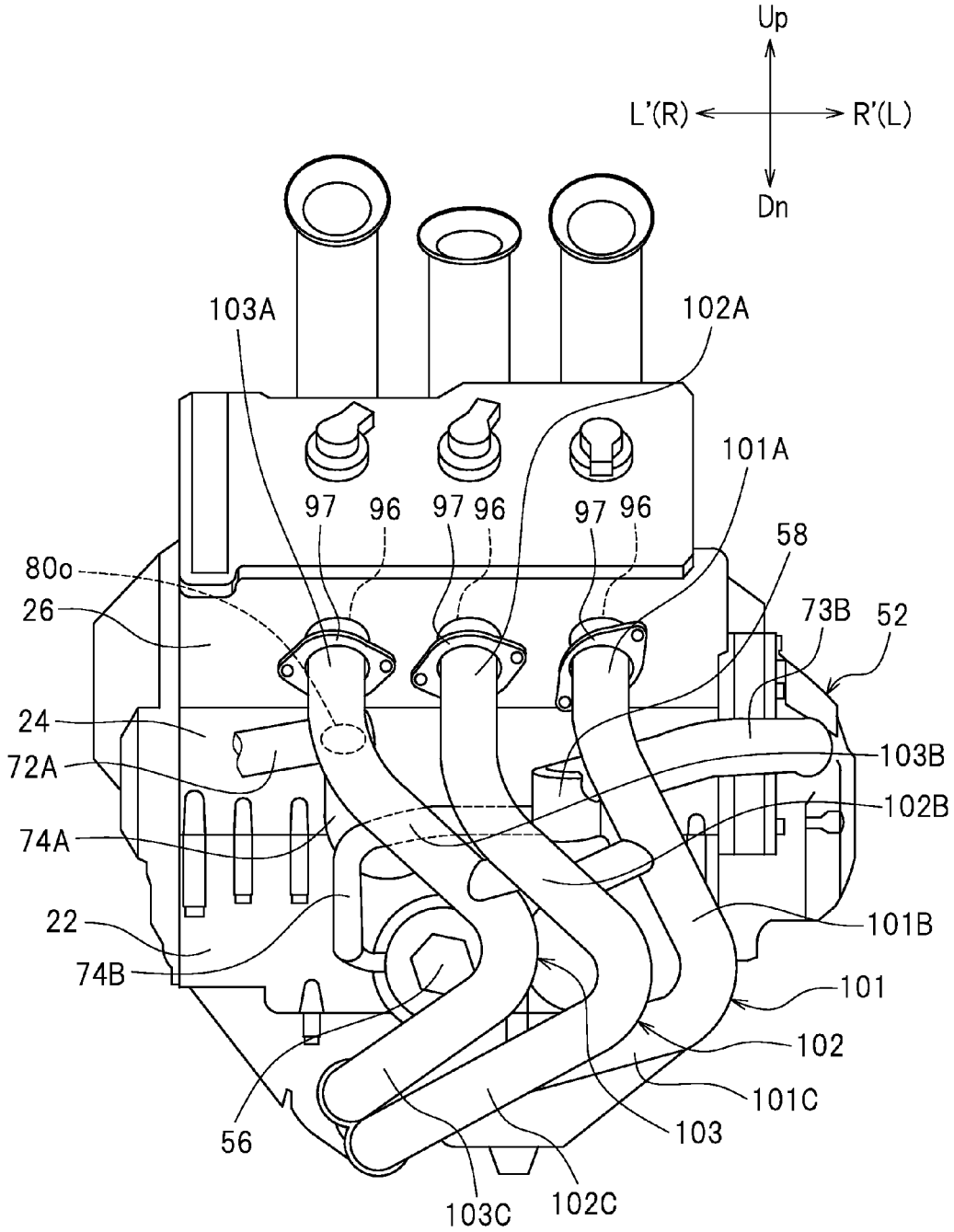
FIG. 13 is a front view of the internal combustion engine, the cooling apparatus, and exhaust pipes.

As illustrated in FIG. 13, the cylinder head 26 is provided with exhaust pipe connection ports 97 connected to the exhaust ports 96. The internal combustion engine 20 preferably includes the first exhaust pipe 101, the second exhaust pipe 102, and the third exhaust pipe 103 which are connected to the exhaust pipe connection ports 97. The first, second, and third exhaust pipes 101, 102, and 103 are in communication with the combustion chambers 43 (see FIG. 2) of the first, second, and third cylinders 31, 32, and 33, respectively. The exhaust pipe connection ports 97 are provided at the front portion of the cylinder head 26, and therefore, the first, second, and third exhaust pipes 101, 102, and 103 are connected to the front portion of the cylinder head 26. As illustrated in FIG. 7, in the side view of the vehicle, the first exhaust pipe 101 preferably includes an upper portion 101A extending obliquely downward and forward from the cylinder head 26, first and second intermediate portions 101B and 101C extending obliquely downward and rearward from the upper portion 101A, and a lower portion 101D extending rearward from the second intermediate portion 101C. As illustrated in FIGS. 7 and 12, in the side view of the vehicle, the second exhaust pipe 102 preferably includes an upper portion 102A extending obliquely downward and forward from the cylinder head 26, first and second intermediate portions 102B and 102C extending obliquely downward and rearward from the upper portion 102A, and a lower portion 102D extending rearward from the second intermediate portion 102C. As illustrated in FIG. 12, in the side view of the vehicle, the third exhaust pipe 103 preferably includes an upper portion 103A extending obliquely downward and forward from the cylinder head 26, first and second intermediate portions 103B and 103C extending obliquely downward and rearward from the upper portion 103A, and a lower portion 103D extending rearward from the second intermediate portion 103C. As illustrated in FIG. 13, in the front view of the vehicle, the first intermediate portions 101B, 102B, and 103B extend obliquely downward and rightward, and the second intermediate portions 101C, 102C, and 103C extend obliquely downward and leftward.

As illustrated in FIG. 12, the thermostat 58 and the oil cooler 56 are disposed rearward of the first, second, and third exhaust pipes 101, 102, and 103. More specifically, the thermostat 58 and the oil cooler 56 are disposed rearward of the intermediate portions 101B and 101C of the first exhaust pipe 101, the intermediate portions 102B and 102C of the second exhaust pipe 102, and the intermediate portions 103B and 103C of the third exhaust pipe 103. The thermostat 58 is disposed between the crankcase 22 and the exhaust pipes 101 to 103 in the front-rear direction.

As illustrated in FIG. 7, in the side view of the vehicle, the water piping 73B is disposed between the crankcase 22 and the first to third exhaust pipes 101 to 103, and between the cylinder body 24 and the first to third exhaust pipes 101 to 103. As illustrated in FIG. 12, in the side view of the vehicle, the water piping 74A and the water piping 74B are also disposed between the crankcase 22 and the first to third exhaust pipes 101 to 103, and between the cylinder body 24 and the first to third exhaust pipes 101 to 103. As illustrated in FIG. 7, in the side view of the vehicle, the water piping 73B, in particular, is disposed compactly within a space defined by the crankcase 22, the cylinder body 24, and the upper portion 101A and the first intermediate portion 101B of the first exhaust pipe 101. As illustrated in FIG. 12, in the side view of the vehicle, a portion of the water piping 72A is disposed rearward of the upper portions 101A to 103A and the first intermediate portions 101B to 103B of the first to third exhaust pipes 101 to 103, and another portion of the water piping 72A intersects with the first to third exhaust pipes 101 to 103 and then connects with the inlet 54*i* of the radiator 54. As illustrated in FIG. 7, in the side view of the vehicle, a portion of the water piping 73A is disposed rearward of the first intermediate portions 101B to 103B of the first to third exhaust pipes 101 to 103, and another portion of the water piping 73A intersects with the first to third exhaust pipes 101 to 103 and then connects with the outlet 54*o* of the radiator 54.

Up to this point, the structures of the internal combustion engine 20 and the cooling apparatus 50 have been described. Next, how the cooling water flows in the cooling apparatus 50 will be described.

During a warming up operation performed immediately after startup of the internal combustion engine 20, the cooling water has a low temperature. In this case, the temperature of the cooling water is lower than the reference temperature of the thermostat 58, and the communication between the first inlet 59*i*1 and the outlet 590 of the thermostat 58 is shut off. In contrast, when the temperature of the cooling water is equal to or higher than the reference temperature of the thermostat 58 after the warming up operation, the first inlet 59*i*1 and the outlet 59*o* of the thermostat 58 are in communication with each other, thus performing an operation of allowing the cooling water that has cooled the internal combustion engine 20 to radiate heat through the radiator 54 (which will hereinafter be referred to as a "normal operation"). Next, how the cooling water flows during the warming up operation and the normal operation will be described.

First, how the cooling water flows during the warming up operation will be described. As indicated by arrows in FIG. 9, the cooling water discharged from the water pump 52 goes into the introduction passage 71, and then flows into the cylinder head cooling passage 81 from the introduction passage 71.

The cooling water, which has flowed into the cylinder head cooling passage 81, flows leftward through the cylinder head cooling passage 81 in the front view of the vehicle. In this case, some of the cooling water flows into the cylinder body cooling passage 82 through the hole 25*b* located rightward of the first cylinder 31 and the holes 25*b* located rearward of the first, second, and third cylinders 31, 32, and 33 in the front view of the vehicle. The remainder of the cooling water flows into the cylinder body cooling passage 82 through the holes 25*b* located leftward of the third cylinder 33 in the front view of the vehicle. Thus, the cooling water inside the cylinder head cooling passage 81 sequentially flows into the cylinder body cooling passage 82 while flowing leftward in the front view of the vehicle.

The cooling water inside the cylinder body cooling passage 82 flows leftward in the front view of the vehicle. The cooling water that has reached a region surrounding the third cylinder 33 then flows out forward from the outlet 80*o*.

Since the communication between the first inlet 59*i*1 and the outlet 590 of the thermostat 58 is shut off, the cooling water, which has flowed out from the outlet 80*o* of the cooling passage 80, does not flow into the radiator 54. As indicated by solid arrows in FIG. 6, the cooling water, which has flowed out from the outlet 80*o*, flows through the water piping 74A, the oil cooler 56 and the water piping 74B, and then flows into the thermostat 58 from the second inlet 59*i*2. The cooling water, which has flowed into the thermostat 58, flows out from the outlet 59*o*, flows through the water piping 73B, and is then drawn into the water pump 52. From then onwards, the cooling water circulates in a similar manner.

Figure 14:
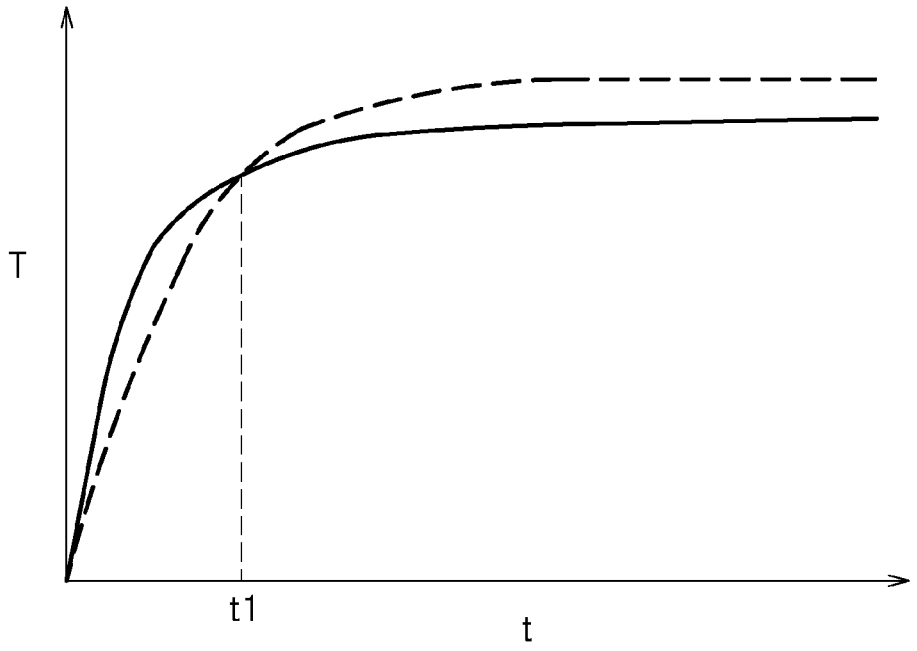
FIG. 14 is a graph illustrating changes in temperatures of cooling water and oil after startup of the internal combustion engine.

FIG. 14 is a graph illustrating relationships between a time t elapsed since the startup of the internal combustion engine 20 and temperatures T of oil and cooling water. In the graph, the solid line represents the temperature of the cooling water, and the broken line represents the temperature of the oil. As illustrated in FIG. 14, after the startup of the internal combustion engine 20, the temperature of the internal combustion engine 20 gradually increases, and the temperature of the cooling water also increases accordingly. However, immediately after the startup of the internal combustion engine 20, the temperature of the cooling water might be higher than the temperature of the oil. In such a case, the oil is heated by the cooling water in the oil cooler 56. Until a time point t1 at which the temperature of the cooling water is equal to the temperature of the oil, the oil cooler 56 functions as a heater that heats the oil. After the time point t1, the temperature of the oil is higher than the temperature of the cooling water, so that the cooling water cools the oil in the oil cooler 56. Before the time point t1, the oil is warmed by the cooling water, and therefore, the temperature of the oil in this case is higher than the temperature of the oil that is not warmed by the cooling water. The internal combustion engine 20 is warmed by the oil that has been warmed by the cooling water, and thus the temperature of the internal combustion engine 20 is increased in a shorter period of time. According to the present preferred embodiment, the internal combustion engine 20 is warmed up more promptly than when the oil is not warmed by the cooling water.

Next, how the cooling water flows during the normal operation will be described. Similarly to the warming up operation, the cooling water discharged from the water pump 52 passes through the introduction passage 71 and the cooling passage 80, and then flows out from the outlet 80*o* (see FIG. 9).

In the thermostat 58, the first inlet 59*i*1 and the outlet 590 are in communication with each other, and the second inlet 59*i*2 and the outlet 590 are in communication with each other. As indicated by broken arrows in FIG. 6, some of the cooling water that has flowed out from the outlet 80*o* flows into the inlet tank 54*b* of the radiator 54 through the water piping 72A. The cooling water, which has flowed into the inlet tank 54*b*, flows through the radiator main body 54*a* rightward in the front view of the vehicle. In this case, the cooling water inside the radiator main body 54*a* exchanges heat with air outside the radiator main body 54*a*, and is thus cooled by this air. The cooling water, which has flowed through the radiator main body 54*a*, flows into the outlet tank 54*c*. The cooling water inside the outlet tank 54*c* flows through the water piping 73A, and then flows into the thermostat 58 from the first inlet 59*i*1.

As indicated by the solid arrows in FIG. 6, the remainder of the cooling water that has flowed out from the outlet 80*o* flows through the oil cooler passage 74. Specifically, this cooling water flows through the water piping 74A, and then flows into the oil cooler 56. The cooling water cools the oil in the oil cooler 56. The cooling water that has flowed out from the oil cooler 56 flows through the water piping 74B, and then flows into the thermostat 58 from the second inlet 59*i*2.

The cooling water, which has flowed into the thermostat 58 from the first inlet 59*i*1, and the cooling water, which has flowed into the thermostat 58 from the second inlet 59*i*2, flow out from the outlet 59*o*, and are then drawn into the water pump 52 through the water piping 73B. From then onwards, the cooling water circulates in a similar manner.

As described above, in the cooling apparatus 50, the cooling water does not flow through the radiator 54 during the warming up operation, and therefore, the cooling water does not radiate heat in the radiator 54 during the warming up operation. Since the temperature of the cooling water is likely to increase during the warming up operation, the internal combustion engine 20 is warmed promptly.

In the cooling apparatus 50, during the warming up operation, the cooling water that has passed through the internal combustion engine 20 returns to the water pump 52 through the oil cooler passage 74 provided with the oil cooler 56. In the cooling apparatus 50, a bypass passage used only during the warming up operation is unnecessary. Accordingly, a reduction in the number of components and a reduction in weight is achieved in the cooling apparatus 50. Furthermore, the number of pieces of water piping of the cooling apparatus 50 is reduced, thus making it possible to improve layout flexibility of the water piping. In particular, the motorcycle 1 is subject to considerable constraints in terms of installation space for vehicle-mounted components, and is thus likely to be subject to constraints in terms of layout of the water piping. Therefore, the improved layout flexibility of the water piping is significantly effective for the motorcycle 1.

As illustrated in FIG. 4, the thermostat 58 is provided in the third passage 73. In the cooling apparatus 50, whether or not to supply the cooling water to the radiator 54 is decided on the basis of the temperature of the cooling water prior to being supplied to the internal combustion engine 20. Hence, whether or not to radiate heat of the cooling water through the radiator 54 is easily decided in an appropriate manner, thus making it possible to suitably perform prompt warming up of the internal combustion engine 20.

Various types of thermostats are known which include, in addition to an in-line type thermostat, a "bottom bypass type" thermostat. A known bottom bypass type thermostat includes a first inlet, a second inlet, and an outlet, and is arranged to shut off communication between the first inlet and the outlet when a temperature of cooling water is lower than a reference temperature, and to shut off communication between the second inlet and the outlet when the temperature of the cooling water is equal to or higher than the reference temperature. However, such a bottom bypass type thermostat is larger in size and more expensive than an in-line type thermostat. In the cooling apparatus 50 according to the present preferred embodiment, no bottom bypass type thermostat is necessary, and the in-line type thermostat 58 can be utilized, for example. As a result, the cooling apparatus 50 is reduced in size and cost.

As illustrated in FIG. 11, the in-line type thermostat 58 preferably includes the small hole 58*e* through which air is discharged at the time of water injection, but the small hole 58*e* is closed by the jiggle valve 58*f* during the normal operation. During the normal operation, the flow of the cooling water through the small hole 58*e* is halted, thus making it possible to increase a flow rate of the cooling water flowing through the radiator 54. As a result, the cooling water is allowed to sufficiently radiate heat through the radiator 54.

In the cooling apparatus 50, the in-line type thermostat 58 is provided, and thus the cooling water flows through the oil cooler 56 not only during the normal operation but also during the warming up operation. The temperature of the cooling water might be higher than the temperature of the oil immediately after the startup of the internal combustion engine 20, and in that case, the oil is warmed in the oil cooler 56. The internal combustion engine 20 is warmed by the oil that has been warmed in the oil cooler 56, and therefore, the internal combustion engine 20 is warmed more promptly than when the oil is not warmed by the cooling water immediately after the startup.

In the cooling apparatus 50, the cooling water flows through both of the second passage 72 and the oil cooler passage 74 during the normal operation, but the flow passage cross-sectional area of the oil cooler passage 74 is smaller than the flow passage cross-sectional areas of each of the second passage 72 and the third passage 73. Hence, the flow rate of the cooling water flowing through the radiator 54 during the normal operation will not be reduced. As a result, during the normal operation, the cooling water is allowed to sufficiently radiate heat through the radiator 54.

The water pump 52 is fixed to the internal combustion engine 20. Thus, a distance between the water pump 52 and the cooling passage 80 of the internal combustion engine 20 is shorter than when the water pump 52 is disposed at a position away from the internal combustion engine 20. In the cooling apparatus 50, the first passage 71 is shortened. Hence, a reduction in weight and an improvement in layout flexibility of the water piping is achieved in the cooling apparatus 50.

The first passage 71 may be provided by water piping, but in the present preferred embodiment, the first passage 71 is preferably provided inside the internal combustion engine 20 as illustrated in FIG. 9. The first passage 71 is provided inside the cylinder body 24. Therefore, the need for water piping defining the first passage 71 is eliminated, thus making it possible to achieve a reduction in the number of components and a reduction in weight in the cooling apparatus 50. Besides, the layout flexibility of the water piping is improved.

As already mentioned above, in the cooling apparatus 50, the bypass passage used only during the warming up operation is unnecessary, and therefore, the entire water piping is made compact. In the present preferred embodiment, the water piping 72A, 73A, 73B, 74A, and 74B may be compactly disposed forward of the internal combustion engine 20. The oil cooler passage 74 and the oil cooler 56 are disposed forward of the internal combustion engine 20, thus making it possible to compactly dispose the oil cooler passage 74 and the oil cooler 56 without causing the oil cooler passage 74 and the oil cooler 56 to interfere with the exhaust pipes 101 to 103.

As illustrated in FIG. 12, the oil cooler 56 is disposed rearward of the radiator 54. Thus, the oil cooler 56 and the radiator 54 can be suitably disposed.

As illustrated in FIG. 6, the water pump 52 and the thermostat 58 are disposed rightward of the vehicle center line CL in the front view of the vehicle. Thus, a distance between the thermostat 58 and the water pump 52 is reduced, so that the water piping 73B is shortened. Alternatively, the water pump 52 and the thermostat 58 may be disposed leftward of the vehicle center line CL in the front view of the vehicle. Also in that case, the water piping 73B through which the thermostat 58 and the water pump 52 are connected to each other is shortened.

As illustrated in FIG. 6, the water pump 52, the thermostat 58, and the outlet 54*o* of the radiator 54 are disposed rightward of the vehicle center line CL in the front view of the vehicle. Thus, distances between the water pump 52, the thermostat 58, and the outlet 54*o* of the radiator 54 are reduced, so that the water piping 73A and 73B is shortened. Alternatively, the water pump 52, the thermostat 58, and the outlet 54*o* of the radiator 54 may be disposed leftward of the vehicle center line CL in the front view of the vehicle. Also in that case, the water piping 73A and 73B is shortened.

The internal combustion engine 20 preferably includes a plurality of cylinders, i.e., the cylinders 31 to 33, which are preferably arranged in a lateral direction of the motorcycle 1. As illustrated in FIG. 6, in the front view of the vehicle, the water pump 52, the thermostat 58, and the outlet 54*o* of the radiator 54 are disposed rightward of the vehicle center line CL, while the outlet 80*o* of the cooling passage 80 of the internal combustion engine 20 and the inlet 54*i* of the radiator 54 are disposed leftward of the vehicle center line CL. Suppose that a region located rightward of the vehicle center line CL in the front view of the vehicle is defined as a first region, and a region located leftward of the vehicle center line CL in the front view of the vehicle is defined as a second region. Then, the water pump 52, the thermostat 58, and the outlet 54*o* of the radiator 54 are disposed in the first region, and the outlet 80*o* of the cooling passage 80 of the internal combustion engine 20 and the inlet 54*i* of the radiator 54 are disposed in the second region. Thus, the water piping 72A, 73A, and 73B is shortened while interference between the water piping 72A and the water piping 73A and 73B is prevented. Alternatively, in the front view of the vehicle, the water pump 52, the thermostat 58 and the outlet 54*o* of the radiator 54 may be disposed leftward of the vehicle center line CL, and the outlet 80*o* of the cooling passage 80 of the internal combustion engine 20 and the inlet 54*i* of the radiator 54 may be disposed rightward of the vehicle center line CL. Suppose that the region located leftward of the vehicle center line CL in the front view of the vehicle is defined as the first region, and the region located rightward of the vehicle center line CL in the front view of the vehicle is defined as the second region. Then, the water pump 52, the thermostat 58, and the outlet 54*o* of the radiator 54 may be disposed in the first region, and the outlet 80*o* of the cooling passage 80 of the internal combustion engine 20 and the inlet 54*i* of the radiator 54 may be disposed in the second region. Also in that case, effects similar to those mentioned above are obtained.

In the present preferred embodiment, the thermostat 58 is disposed in a portion of the third passage 73 at which the third passage 73 connects with the second end portion 74*o* of the oil cooler passage 74. Alternatively, the thermostat 58 may be disposed in a portion of the third passage 73 which is located between the outlet 54*o* of the radiator 54 and the second end portion 74*o*. In that case, the thermostat case 59 may include an inlet and an outlet, and a valve body of the thermostat 58 may be arranged to shut off communication between the inlet and the outlet when the temperature of the cooling water is lower than a reference temperature, and to allow the communication between the inlet and the outlet when the temperature of the cooling water is equal to or higher than the reference temperature. Alternatively, the thermostat 58 may be provided at any position in a portion of the cooling water circuit which leads from the first end portion 74*i* to the second end portion 74*o* via the second passage 72, the radiator 54 and the third passage 73.

Second Preferred Embodiment

A cooling apparatus 50B according to a second preferred embodiment of the present invention differs from the cooling apparatus 50 according to the first preferred embodiment in that the location of a thermostat 58 is changed. Constituent elements similar to those in the first preferred embodiment are identified by similar reference signs, and therefore, description thereof will be omitted.

Figure 15:
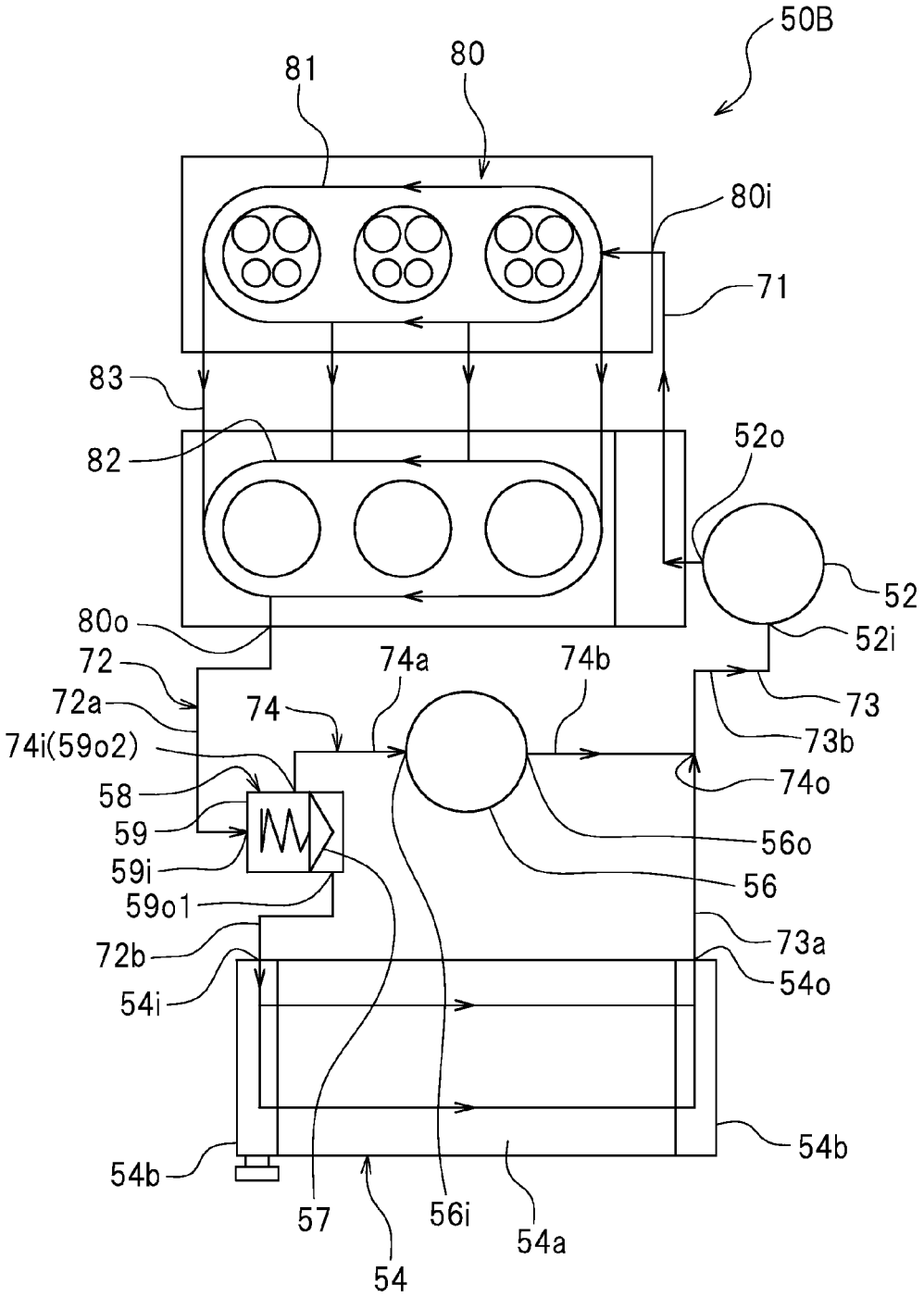
FIG. 15 is a diagram illustrating a cooling water circuit of a cooling apparatus according to a second preferred embodiment of the present invention.
Figure 16A:
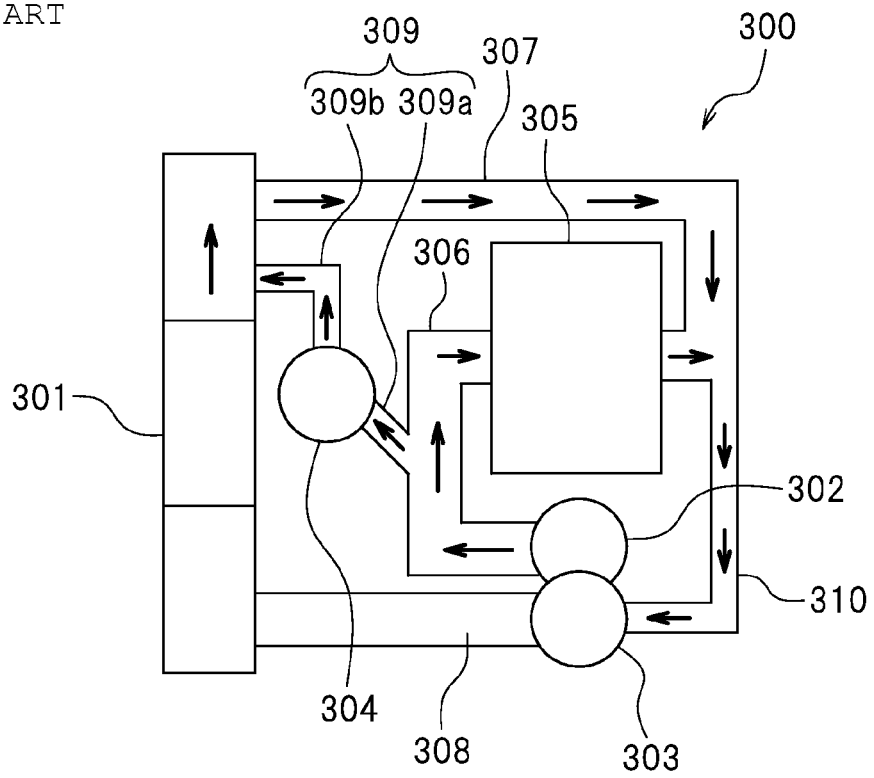
FIG.16A PRIOR ART
FIG. 16A is a diagram of a cooling water circuit of a conventional cooling apparatus which illustrates how cooling water flows during a warming up operation.
Figure 16B:
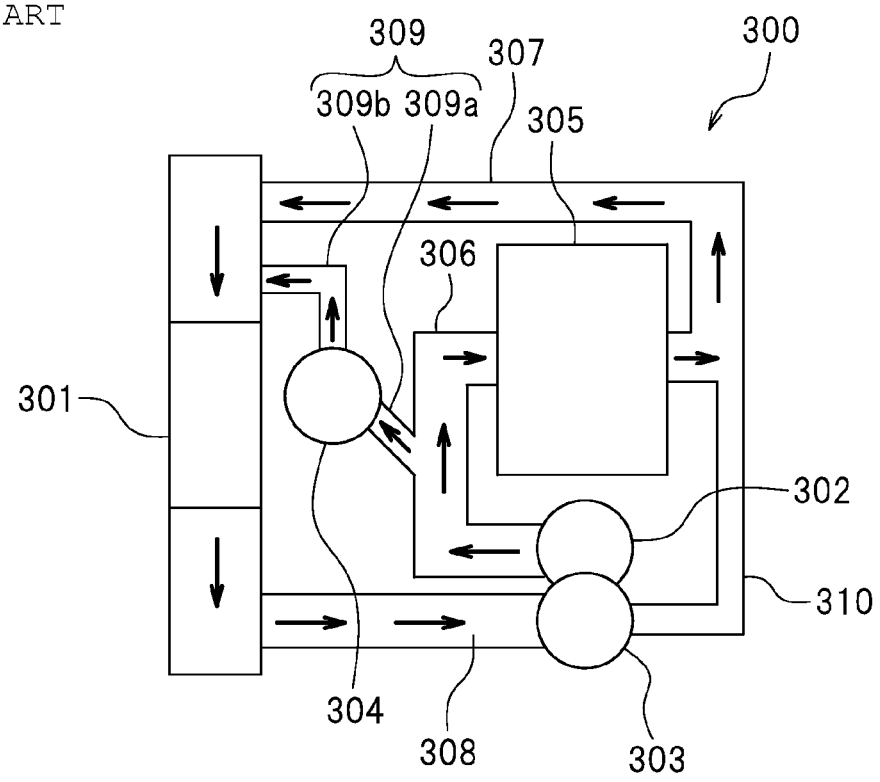
FIG.16B PRIOR ART
FIG. 16B is a diagram of the cooling water circuit of the conventional cooling apparatus which illustrates how the cooling water flows after warming up.

As illustrated in FIG. 15, the cooling apparatus 50B preferably includes an oil cooler passage 74 that includes a first end portion 74*i* connected to a second passage 72, and a second end portion 74*o* connected to a third passage 73. The thermostat 58 is provided in a portion of the second passage 72 which is located between the first end portion 74*i* and an inlet 54*i* of a radiator 54. The thermostat 58 preferably includes a thermostat case 59 provided with an inlet 59*i*, a first outlet 59*o*1, and a second outlet 59*o*2; and a valve body 57 contained inside the thermostat case 59 to open and close communication between the inlet 59*i* and the first outlet 59*o*1.

The second passage 72 preferably includes an upstream passage 72*a* connected to an outlet 80*o* of a cooling passage 80 and the inlet 59*i* of the thermostat 58, and a downstream passage 72*b* connected to the first outlet 59*o*1 of the thermostat 58 and the inlet 54*i* of the radiator 54. The oil cooler passage 74 preferably includes an upstream passage 74*a* connected to the second outlet 59*o*2 of the thermostat 58 and an inlet 56*i* of an oil cooler 56, and a downstream passage 74*b* connected to an outlet 56*o* of the oil cooler 56 and the second end portion 74*o*. Note that the second outlet 59*o*2 of the thermostat 58 defines the first end portion 74*i*.

Also in the present preferred embodiment, the thermostat 58 is preferably an "in-line type" thermostat. The inlet 59*i* and the second outlet 59*o*2 are always in communication with each other. The thermostat 58 is arranged to shut off communication between the inlet 59*i* and the first outlet 59*o*1 by the valve body 57 and allow communication between the inlet 59*i* and the second outlet 59*o*2 when an internal temperature of the thermostat case 59 is lower than a reference temperature. The thermostat 58 is arranged to allow communication between the inlet 59*i* and the first outlet 59*o*1 and allow communication between the inlet 59*i* and the second outlet 59*o*2 when the internal temperature of the thermostat case 59 is equal to or higher than the reference temperature.

During a warming up operation in which a temperature of cooling water is lower than the reference temperature, the cooling water circulates as follows. The cooling water discharged from a water pump 52 flows through a first passage 71 and the cooling passage 80, and then flows into the second passage 72. In the thermostat 58, the communication between the inlet 59*i* and the first outlet 59*o*1 is shut off, and therefore, the cooling water in the second passage 72 is not supplied to the radiator 54 but flows into the third passage 73 through the oil cooler passage 74. The cooling water, which has flowed into the third passage 73, is then drawn into the water pump 52. From then onwards, the cooling water circulates in a similar manner.

During a normal operation in which the temperature of the cooling water is equal to or higher than the reference temperature, the cooling water circulates as follows. The cooling water discharged from the water pump 52 flows through the first passage 71 and the cooling passage 80, and then flows into the second passage 72. In the thermostat 58, the inlet 59*i* and the first outlet 59*o*1 are in communication with each other, and therefore, some of the cooling water that has flowed into the second passage 72 flows into the radiator 54 through the downstream passage 72*b*, passes through the radiator 54, and then flows into the third passage 73. The remainder of the cooling water that has flowed into the second passage 72 flows into the third passage 73 through the oil cooler passage 74. The cooling water that has passed through the radiator 54 and the cooling water that has passed through the oil cooler passage 74 merge with each other, and the merged cooling water is then drawn into the water pump 52. From then onwards, the cooling water circulates in a similar manner.

Also in the present preferred embodiment, a bypass passage used only during the warming up operation is unnecessary. Accordingly, a reduction in the number of components, a reduction in weight, or an improvement in layout flexibility of the water piping is achieved in the cooling apparatus 50B. Since the in-line type thermostat 58 can be used, the cooling apparatus 50B is reduced in size or cost.

As for other features similar to those of the first preferred embodiment, advantageous effects similar to those of the first preferred embodiment are obtained.

In the present preferred embodiment, the thermostat 58 is disposed in a portion of the second passage 72 at which the second passage 72 connects with the first end portion 74*i* of the oil cooler passage 74. Alternatively, the thermostat 58 may be disposed in a portion of the second passage 72 which is located between the first end portion 74*i* and the inlet 54*i* of the radiator 54. In that case, the thermostat case 59 may include an inlet and an outlet, and a valve body of the thermostat 58 may be arranged to shut off communication between the inlet and the outlet when the temperature of the cooling water is lower than a reference temperature, and to allow the communication between the inlet and the outlet when the temperature of the cooling water is equal to or higher than the reference temperature.

As illustrated in FIG. 5, in the first preferred embodiment, the thermostat 58 is separated from the internal combustion engine 20, and therefore, the thermostat 58 and the internal combustion engine 20 are preferably separate components. Alternatively, the thermostat 58 may be integral with the internal combustion engine 20 or the water pump 52. For example, the thermostat case 59 may be integral with the internal combustion engine 20 or the water pump 52. The same goes for the second preferred embodiment. For example, the thermostat 58 according to the second preferred embodiment may be separate from the internal combustion engine 20 and the water pump 52, or may be integral with the internal combustion engine 20 or the water pump 52. In each of the foregoing preferred embodiments, the number of components can be further reduced when the thermostat 58 is integral with the internal combustion engine 20 or the water pump 52.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A cooling apparatus for cooling an internal combustion engine of a motorcycle, the cooling apparatus comprising:

a cooling passage provided in the internal combustion engine and including an inlet through which cooling water flows in, and an outlet through which the cooling water flows out;

a water pump including a discharge port through which the cooling water is discharged, and a suction port through which the cooling water is drawn in;

a radiator including an inlet through which the cooling water flows in, and an outlet through which the cooling water flows out;

a first passage connected to the discharge port of the water pump and the inlet of the cooling passage;

a second passage connected to the outlet of the cooling passage and the inlet of the radiator;

a third passage connected to the outlet of the radiator and the suction port of the water pump;

an oil cooler passage including a first end portion connected to the second passage and a second end portion connected to the third passage, the oil cooler passage including an oil cooler; and a thermostat provided in a portion of the third passage between the outlet of the radiator and the second end portion, the thermostat being arranged to close when a temperature of the cooling water is lower than a reference temperature and to open when the temperature of the cooling water is equal to or higher than the reference temperature; wherein the thermostat includes a thermostat case provided with a first inlet, a second inlet, an outlet, and a valve body contained inside the thermostat case to open and close communication between the first inlet and the outlet;

the third passage includes an upstream passage connected to the outlet of the radiator and the first inlet of the thermostat case, and a downstream passage connected to the outlet of the thermostat case and the suction port of the water pump;

the oil cooler passage includes a downstream passage entirely downstream of the oil cooler, the downstream passage including an end portion connected to the oil cooler and an end portion connected to the second inlet of the thermostat case, the end portion connected to the second inlet of the thermostat case defining the second end portion of the oil cooler passage; and the thermostat is arranged to shut off communication between the first inlet and the outlet by the valve body and allow communication between the second inlet and the outlet when the temperature of the cooling water is lower than the reference temperature, and to allow communication between the first inlet and the outlet and allow communication between the second inlet and the outlet when the temperature of the cooling water is equal to or higher than the reference temperature.

2. The cooling apparatus according to claim 1, wherein the oil cooler passage has a flow passage cross-sectional area smaller than flow passage cross-sectional areas of each of the second passage and the third passage.

3. The cooling apparatus according to claim 1, wherein the water pump is fixed to the internal combustion engine.

4. The cooling apparatus according to claim 3, wherein the first passage is provided inside the internal combustion engine.

5. The cooling apparatus according to claim 4, wherein the internal combustion engine includes a cylinder body including a plurality of cylinders and a cylinder head connected to the cylinder body, the cylinder body including an intake port through which air is introduced and an exhaust port through which exhaust gas is discharged;

the water pump is attached to the cylinder body; and at least a portion of the first passage is provided inside the cylinder body.

6. A motorcycle comprising the cooling apparatus according to claim 1.

7. The motorcycle according to claim 6, wherein the oil cooler passage is disposed forward of the internal combustion engine.

8. The motorcycle according to claim 6, wherein the oil cooler is disposed forward of the internal combustion engine.

9. The motorcycle according to claim 8, wherein the radiator is disposed forward of the internal combustion engine, and the oil cooler is disposed rearward of the radiator.

10. A motorcycle comprising the cooling apparatus according to claim 1, wherein both of the water pump and the thermostat are disposed rightward of a motorcycle center line in a front view of the motorcycle, or disposed leftward of the motorcycle center line in the front view of the motorcycle.

11. A motorcycle comprising the cooling apparatus according to claim 1, wherein the internal combustion engine includes a plurality of cylinders arranged in a lateral direction of the motorcycle; and when one of a region located rightward of a motorcycle center line in a front view of the motorcycle and a region located leftward of the motorcycle center line in the front view of the motorcycle is defined as a first region and the other region is defined as a second region, the water pump, the thermostat, and the outlet of the radiator are disposed in the first region, and the outlet of the cooling passage of the internal combustion engine and the inlet of the radiator are disposed in the second region.

12. The cooling apparatus according to claim 1, wherein the oil cooler is arranged to heat oil in the oil cooler by the cooling water immediately after a startup of the internal combustion engine.

13. A cooling apparatus for cooling an internal combustion engine of a motorcycle, the cooling apparatus comprising:

a cooling passage provided in the internal combustion engine and including an inlet through which cooling water flows in, and an outlet through which the cooling water flows out;

a water pump including a discharge port through which the cooling water is discharged, and a suction port through which the cooling water is drawn in;

a radiator including an inlet through which the cooling water flows in, and an outlet through which the cooling water flows out;

a first passage connected to the discharge port of the water pump and the inlet of the cooling passage;

a second passage connected to the outlet of the cooling passage and the inlet of the radiator, the second passage terminating at the inlet of the radiator;

a third passage connected to the outlet of the radiator and the suction port of the water pump;

an oil cooler passage including a first end portion connected to the second passage and a second end portion connected to the third passage, the oil cooler passage including an oil cooler; and a thermostat provided in a portion of the second passage between the first end portion and the inlet of the radiator, the thermostat being arranged to close when a temperature of the cooling water is lower than a reference temperature and to open when the temperature of the cooling water is equal to or higher than the reference temperature; wherein the thermostat includes a thermostat case provided with an inlet, a first outlet, a second outlet, and a valve body contained inside the thermostat case to open and close communication between the inlet and the first outlet;

the second passage includes an upstream passage connected to the outlet of the cooling passage and the inlet of the thermostat case, and a downstream passage connected to the first outlet of the thermostat case and the inlet of the radiator;

the oil cooler passage includes an upstream passage including an end portion connected to the second outlet of the thermostat case and defining the first end portion, and an end portion connected to the oil cooler; and the thermostat is arranged to shut off communication between the inlet and the first outlet by the valve body and allow communication between the inlet and the second outlet when the temperature of the cooling water is lower than the reference temperature, and to allow communication between the inlet and the first outlet and allow communication between the inlet and the second outlet when the temperature of the cooling water is equal to or higher than the reference temperature.

14. The cooling apparatus according to claim 13, wherein the oil cooler passage has a flow passage cross-sectional area smaller than flow passage cross-sectional areas of each of the second passage and the third passage.

15. The cooling apparatus according to claim 13, wherein the water pump is fixed to the internal combustion engine.

16. The cooling apparatus according to claim 15, wherein the first passage is provided inside the internal combustion engine.

17. The cooling apparatus according to claim 16, wherein the internal combustion engine includes a cylinder body including a plurality of cylinders and a cylinder head connected to the cylinder body, the cylinder body including an intake port through which air is introduced and an exhaust port through which exhaust gas is discharged;

the water pump is attached to the cylinder body; and at least a portion of the first passage is provided inside the cylinder body.

18. The cooling apparatus according to claim 13, wherein the oil cooler is arranged to heat oil in the oil cooler by the cooling water immediately after a startup of the internal combustion engine.

19. A motorcycle comprising the cooling apparatus according to claim 5.

20. The motorcycle according to claim 19, wherein the oil cooler passage is disposed forward of the internal combustion engine.

21. The motorcycle according to claim 19, wherein the oil cooler is disposed forward of the internal combustion engine.

22. The motorcycle according to claim 21, wherein the radiator is disposed forward of the internal combustion engine, and the oil cooler is disposed rearward of the radiator.

* * * * *

UNITED STATES PATENT AND TRADEMARK OFFICE

CERTIFICATE OF CORRECTION

PATENT NO. : 9,279,360 B2
APPLICATION NO. : 14/231984
DATED : March 8, 2016
INVENTOR(S) : Tetsu Miura et al.

It is certified that error appears in the above-identified patent and that said Letters Patent is hereby corrected as shown below:

Claims

The following should be corrected in Claim 19, column 25, line 9 as follows:

"A motorcycle comprising the cooling apparatus according to claim 13."

Signed and Sealed this
Seventeenth Day of May, 2016

Michelle K. Lee

Michelle K. Lee
*Director of the United States Patent and Trademark Office*